US009959987B2

(12) United States Patent
Tanaka

(10) Patent No.: US 9,959,987 B2
(45) Date of Patent: May 1, 2018

(54) SWITCH DEVICE AND METHOD FOR MANUFACTURING SWITCH DEVICE

(71) Applicant: ALPS ELECTRIC CO., LTD., Tokyo (JP)

(72) Inventor: Takaki Tanaka, Miyagi-ken (JP)

(73) Assignee: ALPS ELECTRIC CO., LTD., Tokyo (JP)

( * ) Notice: Subject to any disclaimer, the term of this patent is extended or adjusted under 35 U.S.C. 154(b) by 0 days. days.

(21) Appl. No.: 15/651,375

(22) Filed: Jul. 17, 2017

(65) Prior Publication Data

US 2018/0025855 A1 Jan. 25, 2018

(30) Foreign Application Priority Data

Jul. 22, 2016 (JP) ..... 2016-143924

(51) Int. Cl.
*H01H 13/10* (2006.01)
*H01H 1/58* (2006.01)
*H01H 11/06* (2006.01)

(52) U.S. Cl.
CPC ..... *H01H 1/58* (2013.01); *H01H 11/06* (2013.01); *H01H 13/10* (2013.01); *H01H 2229/048* (2013.01); *H01H 2235/01* (2013.01)

(58) Field of Classification Search
CPC ..... H01H 15/02; H01H 15/06; H01H 1/242; H01H 13/12; H01H 13/28; H01H 13/48; H01H 13/52; H01H 13/56; H01H 13/20; H01H 13/36; H01H 13/365; H01H 13/14; H01H 3/42; H01H 9/041
USPC ..... 200/11 J, 16 C, 61.74, 450, 453, 458, 200/459, 276, 290, 325
See application file for complete search history.

(56) References Cited

U.S. PATENT DOCUMENTS 6,064,294 A * 5/2000 Schwarze ..... H01H 37/38 29/622
6,399,908 B1 * 6/2002 Mueller ..... H01H 1/34 200/249
9,613,765 B2 * 4/2017 Koepsell ..... H01H 3/04
9,741,504 B2 * 8/2017 Shiraishi ..... H01H 13/06
2010/0025205 A1 * 2/2010 Domzalski ..... H01H 13/30 200/1 B (Continued)

FOREIGN PATENT DOCUMENTS

JP 2015-72894 A 4/2015

*Primary Examiner* — Ahmed Saeed
(74) *Attorney, Agent, or Firm* — Brinks Gilson & Lione

(57) ABSTRACT

A switch device includes a housing having a case and a holding member, a moving member, a biasing member, a movable contact, a common fixed contact, a first switching fixed contact, a second switching fixed contact, extending portions, at least two terminal members, and resistors for obtaining the resistance value between two terminal members, and fixing portions to which the resistors are soldered. The holding member includes a bottom wall portion that covers the bottom of the case, and a holding wall portion holding the fixing portions. The holding wall portion is formed of a first synthetic resin material having heat resistance, and the bottom wall portion is made of a second synthetic resin material having a heat distortion temperature lower than that of the first synthetic resin material. A method for manufacturing a switch device includes a first molding step, a resistor mounting step, and a second molding step.

13 Claims, 20 Drawing Sheets

(56) References Cited

U.S. PATENT DOCUMENTS

2011/0147186 A1* 6/2011 Mori ..... H01H 5/06
200/468

* cited by examiner

SWITCH DEVICE AND METHOD FOR MANUFACTURING SWITCH DEVICE

CLAIM OF PRIORITY

This application claims benefit of priority to Japanese Patent Application No. 2016-143924 filed on Jul. 22, 2016, which is hereby incorporated by reference in its entirety.

BACKGROUND

1. Field of the Disclosure

The present disclosure relates to a switch device capable of detecting failure such as open circuit or short circuit, and more specifically, it relates to a switch device having built-in resistors.

2. Description of the Related Art

Recently, a switch device used by connecting it to an external device has been required to be capable of detecting whether or not a failure such as open circuit or short circuit is present in a connecting member such as a wire connected to the external device, in order to ensure the accuracy of ON/OFF of the switch.

As example of such a switch device is disclosed in Japanese Unexamined Patent Application Publication No. 2015-72894. Here, a switch device 900 is proposed that has built-in resistors and a detection circuit and can detect whether the connection between an external device and a wire is in a normal state or a malfunction state of open circuit or short circuit by detecting the resistance value (voltage value) of this detection circuit. FIG. 19 is an exploded perspective view illustrating a switch device 900 of Japanese Unexamined Patent Application Publication No. 2015-72894 (conventional example). FIG. 20 is a vertical sectional view illustrating the switch device 900 of the conventional example.

The switch device 900 shown in FIG. 19 and FIG. 20 includes a box-shaped case 903 that has a through portion 3K1 and has an open bottom, a holding member 902 that covers the bottom of the case 903, a cover member 905 disposed so as to cover the through portion 3K1, a moving member 906 having an operation portion 963 protruding through the through portion 3K1, a biasing member 908 that returns the moving member 906 to an initial state before operation, a movable contact 907 that moves with the movement of the moving member 906, a common fixed contact 925 that is always in contact with the movable contact 907, a first switching fixed contact 926 and a second switching fixed contact 927 whose contact state with the movable contact 907 is switched by the movement of the movable contact 907, a first output terminal 922 and a second output terminal 923 that protrude downward from the holding member 902 and output signals to the outside, and two resistors 909 for obtaining the resistance value (voltage value) between these output terminals.

As shown in FIG. 20, when the switch device 900 is assembled, metal members such as the fixed contacts (first switching fixed contact 926 and second switching fixed contact 927) and the output terminals (first output terminal 922 and second output terminal 923) are partially embedded in synthetic resin material of the holding member 902 by insert-molding. Two resistors 909 (chip resistors) are soldered to parts of metal members that are exposed from synthetic resin material of the holding member 902.

However, when soldering the resistors 909 to the metal members by reflow soldering or the like, it is necessary to use a material having a high heat distortion temperature that can withstand the temperature during soldering, as a synthetic resin material of the holding member 902 in which parts of metal members are embedded. This highly heat-resistant synthetic resin material is expensive, and the cost of the switch device 900 increases. Moreover, when integrating the holding member 902 and the case 903 with adhesive or by lase welding, it is suitable to use the same synthetic resin material, and, in that case, the case 903 is also required to be made of expensive material.

It is possible to perform soldering manually, and a material having a lower heat distortion temperature (more inexpensive material) can be used. However, in the case of a small-sized switch device 900, soldering takes time and the productivity is low, and therefore the cost of the switch device 900 increases.

SUMMARY

A switch device includes a housing having a through portion, a moving member provided with an operation portion exposed from the through portion, a biasing member that returns the moving member to an initial state before operation, a movable contact that moves with the movement of the moving member, a common fixed contact that is always in contact with the movable contact, a first switching fixed contact, the first switching fixed contact being in contact with the movable contact in the initial state where the operation portion is not operated, the first switching fixed contact coming out of contact with the movable contact with the operation of the operation portion, a second switching fixed contact, the second switching fixed contact being out of contact with the movable contact in the initial state where the operation portion is not operated, the second switching fixed contact coming into contact with the movable contact with the operation of the operation portion, extending portions that extend from at least two of the common fixed contact, the first switching fixed contact, and the second switching fixed contact, at least two terminal members that extend from the housing to the outside, and two resistors for obtaining the resistance value between the at least two terminal members. The housing includes a box-shaped case that has the through portion and has an open bottom, and a holding member in which the terminal members are embedded and that covers the bottom of the case. Some of the extending portions and the terminal members have fixing portions to which the resistors are soldered. The holding member includes a bottom wall portion that covers the bottom of the case, and a holding wall portion provided above the bottom wall portion and holding the fixing portions. The holding wall portion is formed of a first synthetic resin material having heat resistance, and the bottom wall portion is made of a second synthetic resin material having a heat distortion temperature lower than that of the first synthetic resin material.

During soldering such as reflow soldering, the holding wall portion can withstand the temperature of soldering such as reflow soldering, and the resistors can be reliably soldered to the fixing portions. On the other hand, since the switch device has the bottom wall portion separately from the holding wall portion, the bottom wall portion can be made of inexpensive material that need not withstand the temperature during soldering. The cost of the switch device can thereby be suppressed.

In another aspect of the present invention, there is provided a method for manufacturing a switch device including a housing having a through portion, a moving member provided with an operation portion exposed from the through portion, a biasing member that returns the moving member to an initial state before operation, a movable contact that moves with the movement of the moving member, a common fixed contact that is always in contact with the movable contact, a first switching fixed contact, the first switching fixed contact being in contact with the movable contact in the initial state where the operation portion is not operated, the first switching fixed contact coming out of contact with the movable contact with the operation of the operation portion, a second switching fixed contact, the second switching fixed contact being out of contact with the movable contact in the initial state where the operation portion is not operated, the second switching fixed contact coming into contact with the movable contact with the operation of the operation portion, extending portions that extend from at least two of the common fixed contact, the first switching fixed contact, and the second switching fixed contact, at least two terminal members that extend from the housing to the outside, and two resistors for obtaining the resistance value between the at least two terminal members. The housing includes a box-shaped case that has the through portion and has an open bottom, and a holding member in which the terminal members are embedded and that covers the bottom of the case. Some of the extending portions and the terminal members have fixing portions to which the resistors can be soldered. The holding member includes a bottom wall portion that covers the bottom of the case, and a holding wall portion provided above the bottom wall portion and holding the fixing portions. The holding wall portion is formed of a first synthetic resin material having heat resistance, and the bottom wall portion is made of a second synthetic resin material having a heat distortion temperature lower than that of the first synthetic resin material. The method includes a first molding step in which the holding wall portion is formed, with the fixing portions exposed, by insert-molding a metal member having the fixing portions using the first synthetic resin material, a resistor mounting step in which the resistors are soldered to the fixing portions, and a second molding step in which the bottom wall portion is formed by insert-molding the terminal members located on the lower side of the holding wall portion using the second synthetic resin material.

In the resistor mounting step, the resistors can be reliably soldered to the fixing portions by high-temperature heating. In the second molding step, the bottom wall portion can be made of inexpensive material that need not withstand the temperature during soldering, and the manufacturing cost of the switch device can be suppressed.

BRIEF DESCRIPTION OF THE DRAWINGS

FIG. 2A is an upper perspective view of the switch device, and FIG. 2B is a lower perspective view of the switch device;

FIG. 3A is a perspective view with the case shown in FIG. 2A omitted, and FIG. 3B is a front view as seen from the Y2 side of FIG. 3A;

FIG. 4A is a front view of a holding member as seen from the Y2 side shown in FIG. 1, and FIG. 4B is a lower perspective view of the case shown in FIG. 1;

FIG. 5A is a back view of the holding member as seen from the Y1 side shown in FIG. 1, and FIG. 5B is a side view of the holding member as seen from the X1 side shown in FIG. 1;

FIG. 15A is a front view illustrating a second molding step, and FIG. 15B is a front view illustrating a cutting step;

FIG. 17A is a front view with the case shown in FIG. 16 omitted, and FIG. 17B is a front view showing only the fixed contacts and the terminal members shown in FIG. 17A;

DESCRIPTION OF THE EXEMPLARY EMBODIMENTS

Embodiments of the present invention will now be described with reference to the drawings.

First Embodiment

Figure 1:
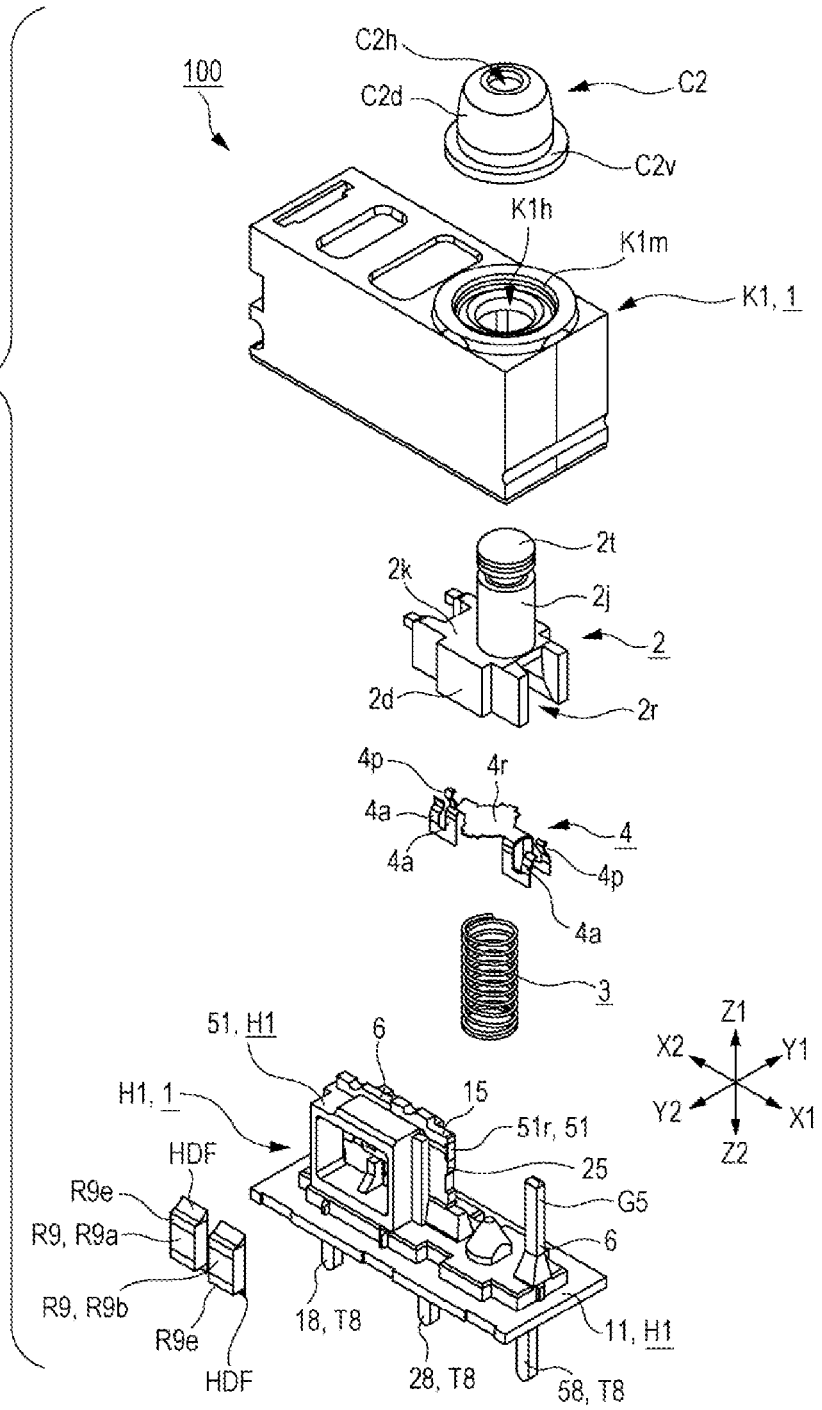
FIG. 1 is an exploded perspective view of a switch device according to a first embodiment of the present invention.
Figure 2A:
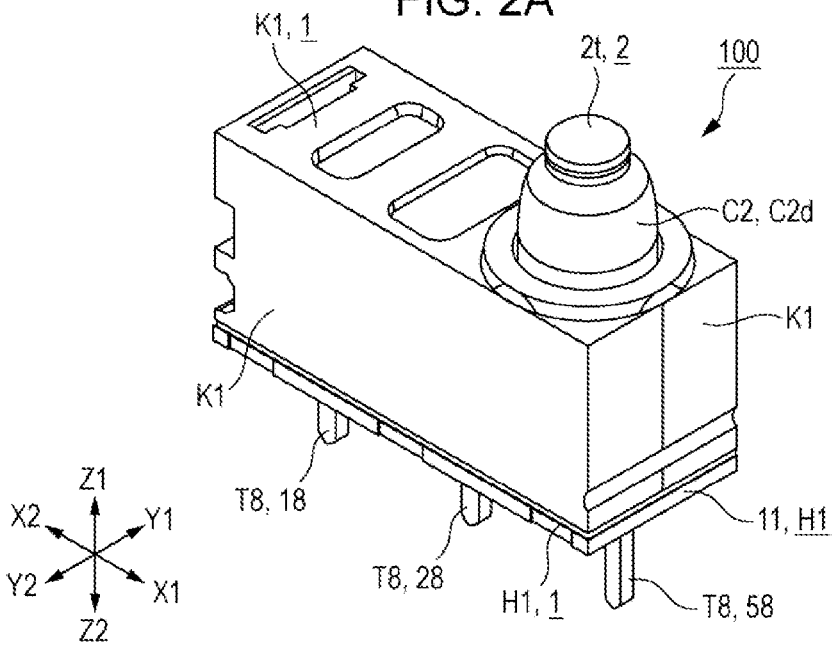
FIGS. 2A and 2B illustrate the switch device according to the first embodiment of the present invention.
Figure 2B:
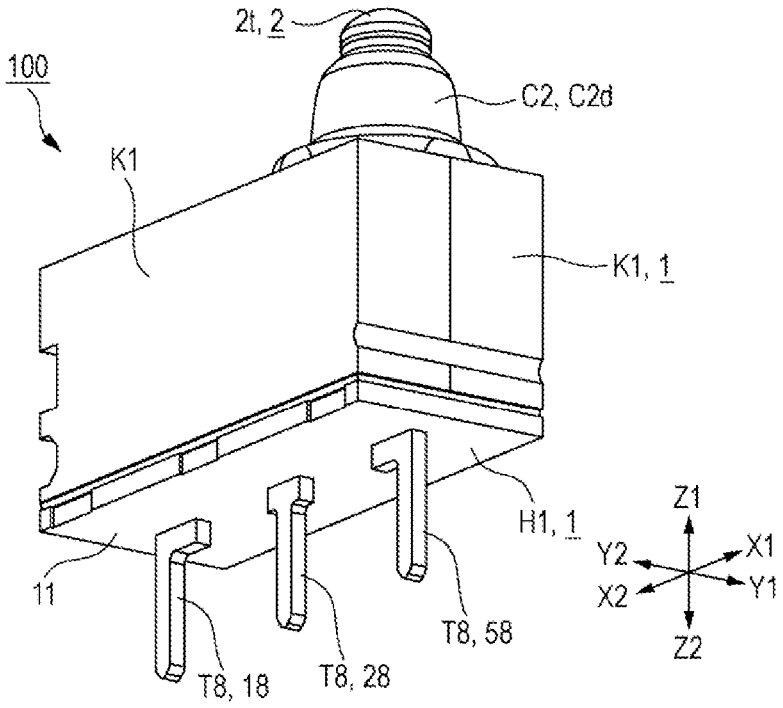
Figure 3A:
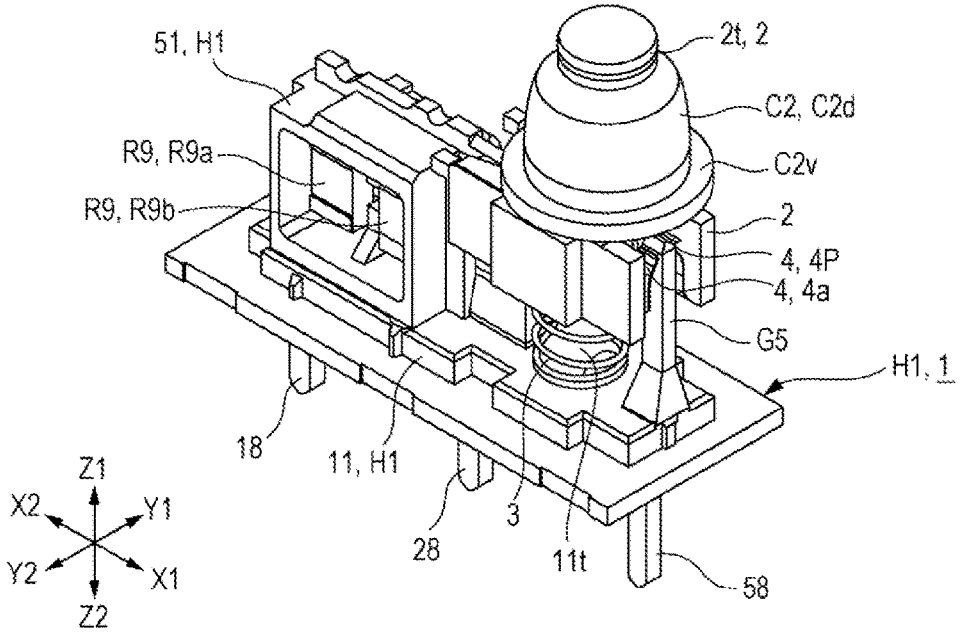
FIGS. 3A and 3B illustrate the switch device according to the first embodiment of the present invention.
Figure 3B:
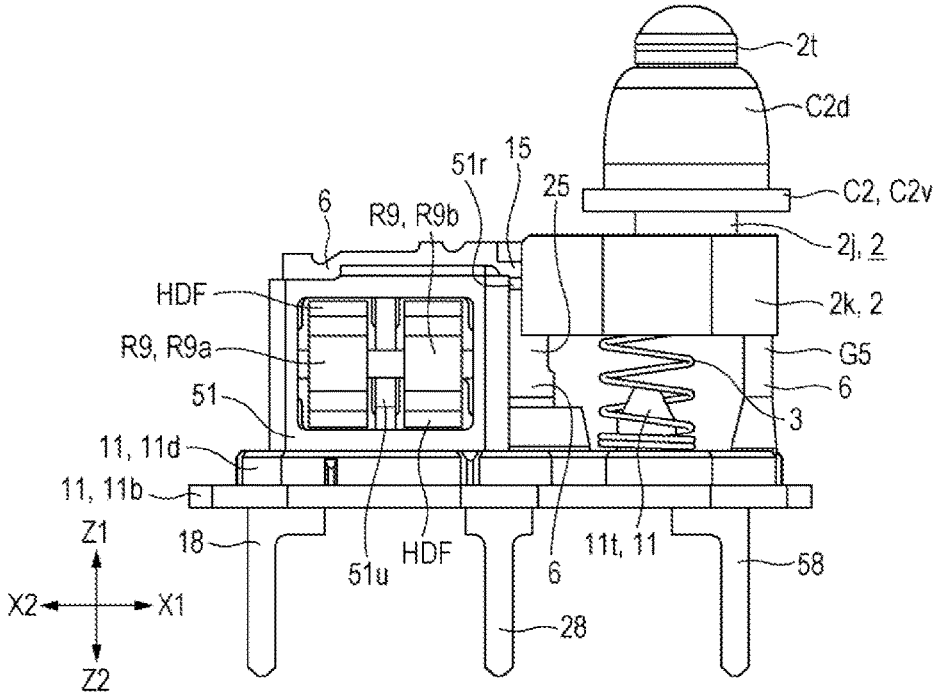

FIG. 1 is an exploded perspective view of a switch device 100. FIG. 2A is an upper perspective view of the switch device 100, and FIG. 2B is a lower perspective view of the switch device 100. FIG. 3A is a perspective view with the case K1 shown in FIG. 2A omitted, and FIG. 3B is a front view as seen from the Y2 side of FIG. 3A. FIGS. 2A, 2B, 3A, and 3B show an initial state where an operation portion 2*t* is not operated.

The switch device 100 of a first embodiment of the present invention has a box-like appearance shown in FIGS. 2A and 2B, and as shown in FIG. 1 and FIGS. 3A and 3B, it includes a housing 1 that forms an outer shape, a moving member 2 that is moved by operating an operation portion 2*t*, a biasing member 3 that returns the moving member 2 to the initial state before operation, a movable contact 4 that moves with the movement of the moving member 2, a common fixed contact G5 that is always in contact with the movable contact 4, a first switching fixed contact 15 and a second switching fixed contact 25 that come into and out of contact with the movable contact 4 with the operation of the operation portion 2*t*, extending portions 6 that extend from the common fixed contact G5, the first switching fixed contact 15, and the second switching fixed contact 25, terminal members T8 that extend from the housing 1 to the outside, two resistors R9 for obtaining the resistance value (voltage value) between two terminal members T8. In the first embodiment of the present invention, the switch device 100 further has a cover member C2 disposed on the upper side (Z1 side shown in FIGS. 2A and 2B) of the housing 1 as shown in FIGS. 2A and 2B.

Next, each of the components of the switch device 100 will be described in detail.

Figure 4A:
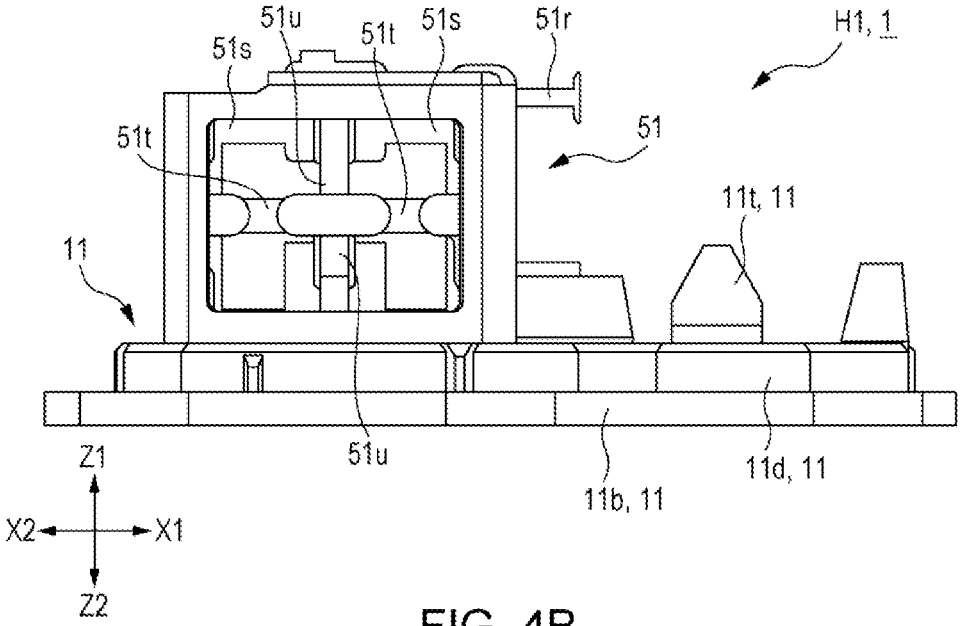
FIGS. 4A and 4B illustrate the housing of the switch device according to the first embodiment of the present invention.
Figure 4B:
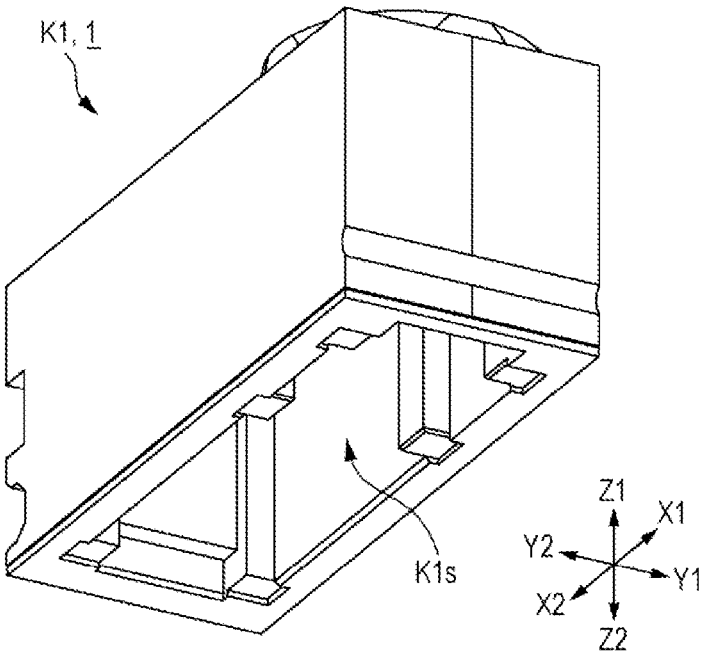
Figure 5A:
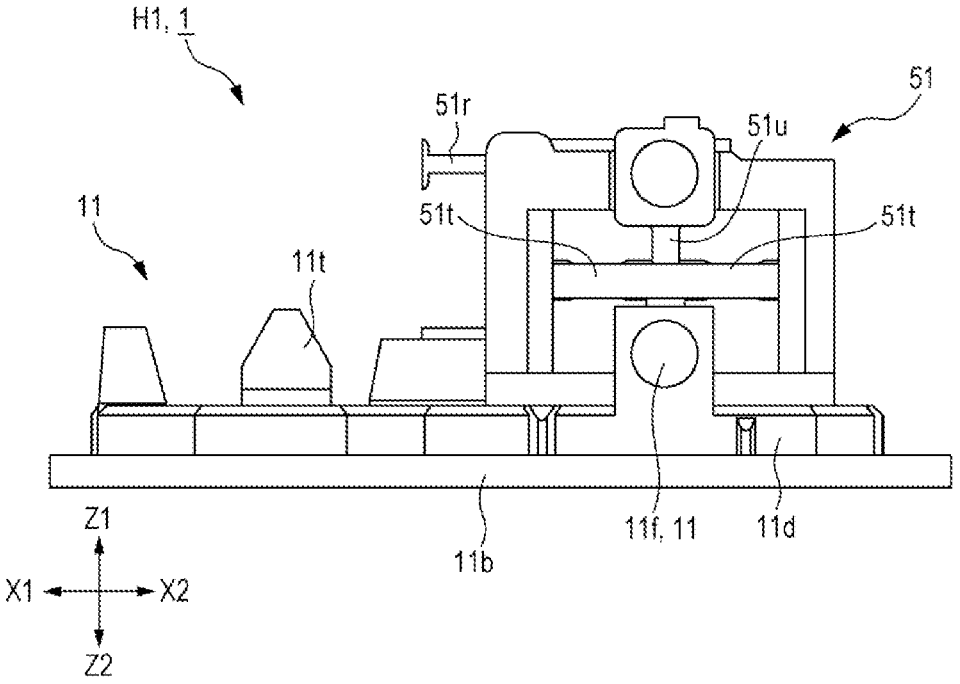
FIGS. 5A and 5B illustrate the holding member of the switch device according to the first embodiment of the present invention.
Figure 5B:
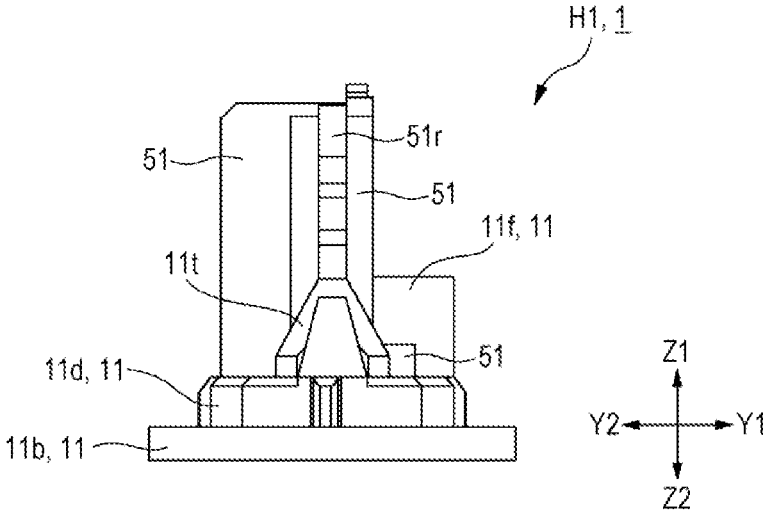
Figure 6:
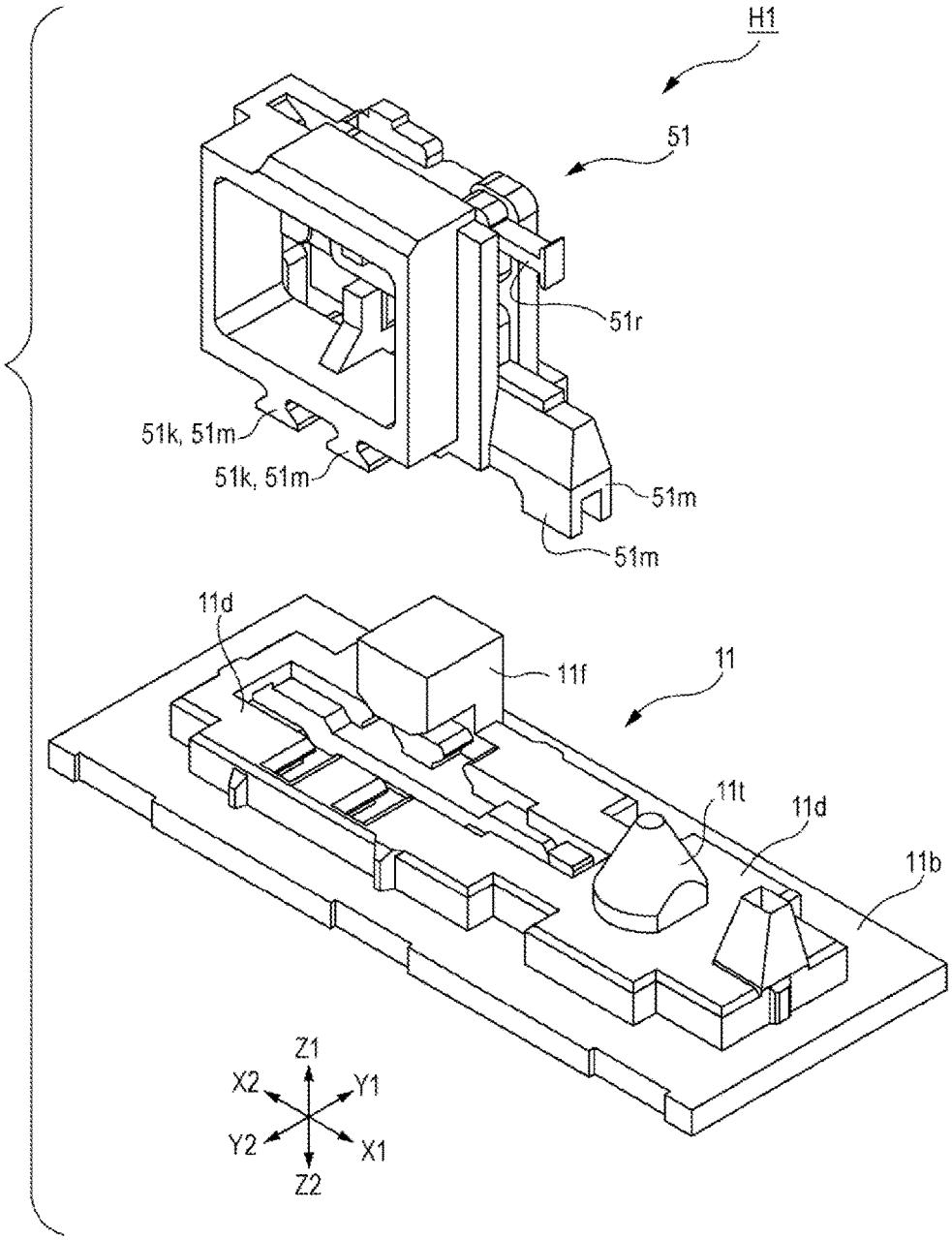
FIG. 6 is an exploded perspective view of the holding member of the switch device according to the first embodiment of the present invention.
Figure 7:
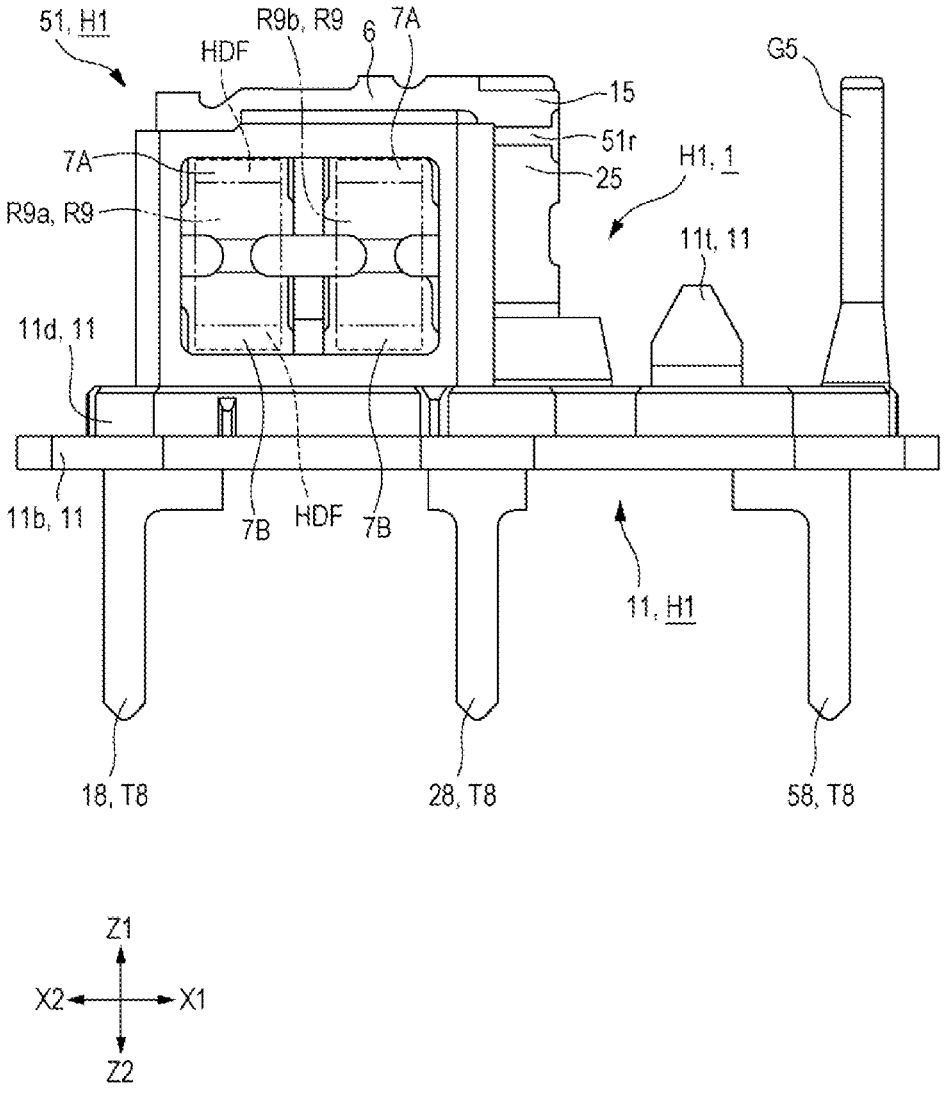
FIG. 7 illustrates the switch device according to the first embodiment of the present invention, and is a front view of the holding member part shown in FIG. 1 as seen from the Y2 side.

First, the housing 1 of the switch device 100 will be described. FIGS. 4A and 4B illustrate the housing 1, and FIG. 4A is a front view of a holding member H1 as seen from the Y2 side shown in FIG. 1. FIG. 4B is a lower perspective view of the case K1 shown in FIG. 1. FIG. 5A is a back view of the holding member H1 as seen from the Y1 side shown in FIG. 1, and FIG. 5B is a side view of the holding member H1 as seen from the X1 side shown in FIG. 1. FIG. 6 is an exploded perspective view of the holding member H1. FIG. 7 is a front view of the holding member H1 part shown in FIG. 1 as seen from the Y2 side. In FIG. 7, for ease of explanation, two resistors R9 (resistors R9*a* and R9*b*) are shown in two-dot chain line, and solder fillets HDF are shown in dashed line.

The housing 1 of the switch device 100 is formed of synthetic resin material, and includes a holding member H1 in which the terminal members T8 are embedded as shown in FIG. 4A, and a box-shaped case K1 having an open bottom as shown in FIG. 4B. As shown in FIG. 2B, the holding member H1 is disposed so as to cover the bottom of the case K1, and the holding member H1 and the case K1 are integrated.

First, as shown in FIG. 4A, FIGS. 5A and 5B, and FIG. 6, the holding member H1 of the housing 1 includes a bottom wall portion 11 that covers the bottom of the case K1 (see FIG. 2B), and a holding wall portion 51 provided above the bottom wall portion 11.

The holding wall portion 51 of the holding member H1 is formed of a first synthetic resin material having heat resistance that can withstand the temperature during soldering, is formed in a rectangular frame shape as shown in FIG. 4A and FIG. 5A, and is made by insert-molding the first switching fixed contact 15, the second switching fixed contact 25, and others shown in FIG. 7. In the first embodiment of the present invention, glass fiber-containing polyamide resin (PA) having a heat distortion temperature of about 250° C. to 300° C. is used as the first synthetic resin material. Glass fiber-containing polyphenylenesulfide resin (PPS) having a heat distortion temperature of about 250° C. to 270° C., or glass fiber-containing liquid crystal polymer (LCP) having a heat distortion temperature of about 250° C. to 360° C. can also be suitably used as the first synthetic resin material.

The heat distortion temperature as used herein is the temperature at which a synthetic resin material specimen deforms a specified amount under a specified load determined in accordance with a test standard, and is also referred to as deflection temperature under load. Since the melting temperature of general solder (lead-free solder) is 217° C. to 220° C., as described later, the reflow temperature when reflow soldering electric components such as the resistors R9 to fixing portions 7A and 7B or the like is generally 220° C. to 250° C. Therefore, the first synthetic resin material only has to have heat resistance that can withstand the reflow temperature, the temperature during soldering. Therefore, in the first embodiment of the present invention, the first synthetic resin material is not limited to those described above, and may be any other thermoplastic synthetic resin material having a heat distortion temperature higher than 250° C. (the general upper limit of reflow temperature).

As shown in FIG. 6, the holding wall portion 51 has, in the lower part thereof, embedded portions 51*m* that are embedded in the bottom wall portion 11. The embedded portions 51*m* are each provided with an engaging portion 51*k* formed such that the lower part thereof is larger than the upper part thereof. Therefore, even when the bottom wall portion 11 is formed of a synthetic resin material different from the first synthetic resin material forming the holding wall portion 51, the firmness of engagement (adhesion) therebetween can be improved. Even when the holding wall portion 51 is formed of the first synthetic resin material, and the bottom wall portion 11 is formed of the second synthetic resin material different from the first synthetic resin material, the firmness of engagement (adhesion) therebetween can be improved. Therefore, for example, in the assembly step, the holding wall portion 51 and the bottom wall portion 11 can be easily handled as an integrated component.

As shown in FIG. 4A, FIG. 5A, and FIG. 6, the holding wall portion 51 has an insulating portion 51*r* extending outward from the frame-like outer shape part. As shown in FIG. 7, the insulating portion 51*r* is disposed so as to be sandwiched between the first switching fixed contact 15 and the second switching fixed contact 25. This ensures the insulation between the first switching fixed contact 15 and the second switching fixed contact 25. Although not shown in detail, the surface of the insulating portion 51*r* is flush with the surfaces of the first switching fixed contact 15 and the second switching fixed contact 25. Therefore, when the movable contact 4 (contact portions 4*p* described later) moves, the movable contact 4 can move smoothly because there is no difference in level between the first switching fixed contact 15 and the insulating portion 51*r* and between the insulating portion 51*r* and the second switching fixed contact 25.

The frame-like inner part of the holding wall portion 51 has, as shown in FIG. 4A, a support portion 51*s* that supports, from behind, fixing portions 7A (described later) to which the resistors R9 shown in FIG. 7 are soldered, a first bar portion 51*t* disposed so as to separate two electrode portions R9*e* (described later, see FIG. 1) of each resistor R9, and a second bar portion 51*u* disposed so as to separate the two resistors R9 (resistors R9*a* and R9*b*).

The bottom wall portion 11 of the holding member H1 is made by injection molding of a second synthetic resin material having a heat distortion temperature lower than that of the first synthetic resin material. Therefore, the bottom wall portion 11 can be made of inexpensive material that need not withstand the temperature during soldering. In the first embodiment of the present invention, glass fiber-containing polybutylene terephthalate resin (PBT) having a heat distortion temperature of about 120° C. to 220° C. is used as the second synthetic resin material.

Non-glass-fiber-containing polyacetal resin (POM, polyoxymethylene) having a heat distortion temperature of about 90° C. to 130° C., or glass fiber-containing polyacetal resin (POM) having a heat distortion temperature of about 110° C. to 170° C. can also be suitably used as the second synthetic resin material. Thermoplastic synthetic resin materials such as acrylonitrile butadiene styrene copolymer resin (ABS), polycarbonate resin (PC), and polyethylene terephthalate resin (PET) can also be used as the second synthetic resin material. The synthetic resin material used is selected in consideration of the usage environment or the like of the product to which the present invention is applied.

As shown in FIG. 6, the bottom wall portion 11 is formed in a rectangular plate shape and includes a base portion 11*b* that forms the bottom surface of the housing 1, a platform portion lid that is inserted into the housing portion K1*s* of the case K1, a protruding portion 11*f* formed so as to protrude upward from the platform portion 11*d*, and a conical attachment portion lit formed on the platform portion 11*d*.

The terminal members T8 shown in FIG. 7 are partially embedded in the base portion 11*b* and the platform portion 11*d* of the bottom wall portion 11. The biasing member 3 is attached to the attachment portion 11*t* of the bottom wall portion 11 (see FIGS. 3A and 3B).

As described above, the embedded portions 51*m* of the holding wall portion 51 are embedded in the platform portion 11*d* of the bottom wall portion 11, and the engaging portions 51*k* of the embedded portions 51*m* are engaged and integrated with the platform portion 11*d* of the bottom wall portion 11. Therefore, even when the holding wall portion 51 is formed of the first synthetic resin material and the bottom wall portion 11 is formed of the second synthetic resin material different from the first synthetic resin material, the firmness of engagement (adhesion) therebetween can be improved. Therefore, for example, in the assembly step, the holding wall portion 51 and the bottom wall portion 11 can be easily handled as an integrated component. For example, even if the holding wall portion 51 and the bottom wall portion 11 are subjected to shock due to dropping or the like during manufacturing, they are not separated. The holding member H1 is made by, after forming the holding wall portion 51, insert molding this holding wall portion 51, and forming the bottom wall portion 11.

As shown in FIG. 5B, the protruding portion 11*f* of the bottom wall portion 11 is formed in an L shape so as to face and engage with the lower part of the holding wall portion 51. Therefore, even when the holding wall portion 51 is formed of the first synthetic resin material and the bottom wall portion 11 is formed of the second synthetic resin material different from the first synthetic resin material, the firmness of engagement (adhesion) therebetween can be improved.

Next, the case K1 of the housing 1 is formed of a third synthetic resin material having a heat distortion temperature lower than that of the first synthetic resin material, and is made by injection molding in a box-like shape having a housing portion K1*s* capable of housing the moving member 2, the biasing member 3, the movable contact 4, and others shown in FIG. 1. Therefore, the case K1 can be made of inexpensive material that need not withstand the temperature during soldering.

In particular, in the first embodiment, the second synthetic resin material and the third synthetic resin material are the same type of material. That is, in the first embodiment of the present invention, glass fiber-containing polybutylene terephthalate resin (PBT) having a heat distortion temperature of about 120° C. to 220° C. is used as the third synthetic resin material. Thermoplastic synthetic resin materials such as polyacetal resin (POM), acrylonitrile butadiene styrene copolymer resin (ABS), polycarbonate resin (PC), and polyethylene terephthalate resin (PET) can also be used as the third synthetic resin material.

For example, when the second synthetic resin material is polybutylene terephthalate resin (PBT), the third synthetic resin material is the same type of polybutylene terephthalate resin (PBT). Therefore, when integrating the holding member H1 (bottom wall portion 11) and the case K1, laser welding can be suitably used. Therefore, the holding member H1 and the case K1 can be easily integrated, and the adhesion and joint strength between the holding member H1 and the case K1 can be improved. Therefore, the airtightness between the holding member H1 and the case K1 can be improved.

Although not shown in detail, guide portions that guide the moving member 2 so that the moving member 2 can be reciprocated in the vertical direction (Z direction shown in FIGS. 2A and 2B) are provided in the housing portion K1*s* of the case K1.

A through portion K1*h* (see FIG. 1) through which an operation shaft portion 2*j* (described later) of the moving member 2 is passed is formed in the upper surface of the case K1. Although not shown, the operation shaft portion 2*j* protrudes from the through portion K1*h* to above the case K1.

As shown in FIG. 2A, a cover member C2 that covers the protruding operation shaft portion 2*j* is disposed on the upper opening side of the through portion K1*h*. A groove portion K1*m* that engages with the lower part of the cover member C2 is provided in the opening of the through portion K1*h* shown in FIG. 1. The cover member C2 is airtightly engaged with the groove portion K1*m*.

The thus-configured housing 1 of the first embodiment of the present invention is formed by assembling and integrating the case K1 and the holding member H1. The above-described holding wall portion 51 is disposed in a sealed housing space formed by the case K1 and the bottom wall portion 11. Therefore, the holding wall portion 51 is not exposed outside the housing 1, and the joint (interface) between the holding wall portion 51 and the bottom wall portion 11 and the joint between the holding wall portion 51 and the case K1 are not exposed to the outside. Therefore, only the joint between the case K1 and the bottom wall portion 11 is exposed to the outside, and it is not necessary to consider the adhesion between the holding wall portion 51 and the bottom wall portion 11 and between the holding wall portion 51 and the case K1. Therefore, the degree of freedom of selection of synthetic resin material of the holding wall portion 51 can be improved. Even if the adhesion between the holding wall portion 51 and the bottom wall portion 11 is poor, water does not enter through this interface, and therefore good waterproof effect can be obtained.

Next, the moving member 2 of the switch device 100 will be described. As shown in FIG. 1, the moving member 2 of the switch device 100 mainly includes an operation base portion 2*k* that holds the movable contact 4 in the housing 1, an operation shaft portion 2*j* protruded from the upper surface of the operation base portion 2*k*, and an operation portion 2*t* formed at the distal end of the operation shaft portion 2*j*. The moving member 2 is configured to move vertically when the operation portion 2*t* is operated.

Although not shown in detail, the operation base portion 2*k* of the moving member 2 has a substantially U-shaped recessed portion 2*r* that houses the movable contact 4. A connection base portion 4*r* of the movable contact 4 described later is fixed to the ceiling surface of the recessed portion 2*r* by caulking or the like. The operation base portion 2*k* has, on the side surfaces thereof, outwardly protruding stepped portions 2*d* (see FIG. 1). Although not shown in detail, the stepped portions 2*d* engage with the guide portions provided in the housing portion K1*s* of the case K1 so that the moving member 2 can reciprocate vertically.

As shown in FIG. 1, the operation shaft portion 2*j* of the moving member 2 is formed in a cylindrical shape. Although not shown, the operation shaft portion 2*j* is passed through the through portion K1*h* of the case K1 and protrudes above the case K1.

The operation portion 2*t* of the moving member 2 is formed at the distal end of the operation shaft portion 2*j*, and is exposed from the top of the cover member C2 as shown in FIG. 2A. The joint part between the operation shaft portion 2*j* and the operation portion 2*t* is recessed, and the top of the cover member C2 is airtightly engaged with this part. The operation portion 2*t*, which is the distal end part of the moving member 2 (operation shaft portion 2*j*), is depressed, for example, by an actuator (not shown). The moving member 2 is formed of a synthetic resin material such as acrylonitrile butadiene styrene copolymer resin (ABS), polycarbonate resin (PC), or polyacetal resin (POM, polyoxymethylene), and the operation base portion 2*k*, the operation shaft portion 2*j*, and the operation portion 2*t* are integrally formed by injection molding or the like.

Next, the cover member C2 of the switch device 100 will be described. The cover member C2 of the switch device 100 is formed of a flexible elastic material such as silicone rubber. As shown in FIG. 1, the cover member C2 has a flange portion C2*v* that is engaged with the groove portion K1*m* of the case K1, a dome portion C2*d* that is formed continuously with the flange portion C2*v*, and a through-hole C2*h* that is formed substantially in the center of the dome portion C2*d*.

The cover member C2 is disposed on the upper surface of the case K1 so as to cover the through portion K1*h*, the flange portion C2*v* is engaged with the groove portion K1*m*, and the through-hole C2*h* is engaged with the recessed joint part between the operation shaft portion 2*j* and the operation portion 2*t*. The operation portion 2*t*, which is the distal end part of the operation shaft portion 2*j*, is thereby exposed from the through-hole C2*h* of the cover member C2. The flange portion C2*v* may be firmly fixed to the case K1 by inwardly deforming the ring-like resin wall portion around the opening of the case K1 by caulking.

The dome portion C2*d* of the cover member C2 is formed so as to have a small wall thickness, and is configured to be easily reversely deformed with the vertical motion (reciprocal motion) of the operation portion 2*t* (operation shaft portion 2*j*). Therefore, the dome portion C2*d* does not adversely affect the motion of the moving member 2. Thus, the entrance of dust, water, and the like into the switch device 100 can be prevented by the cover member C2.

Figure 8:
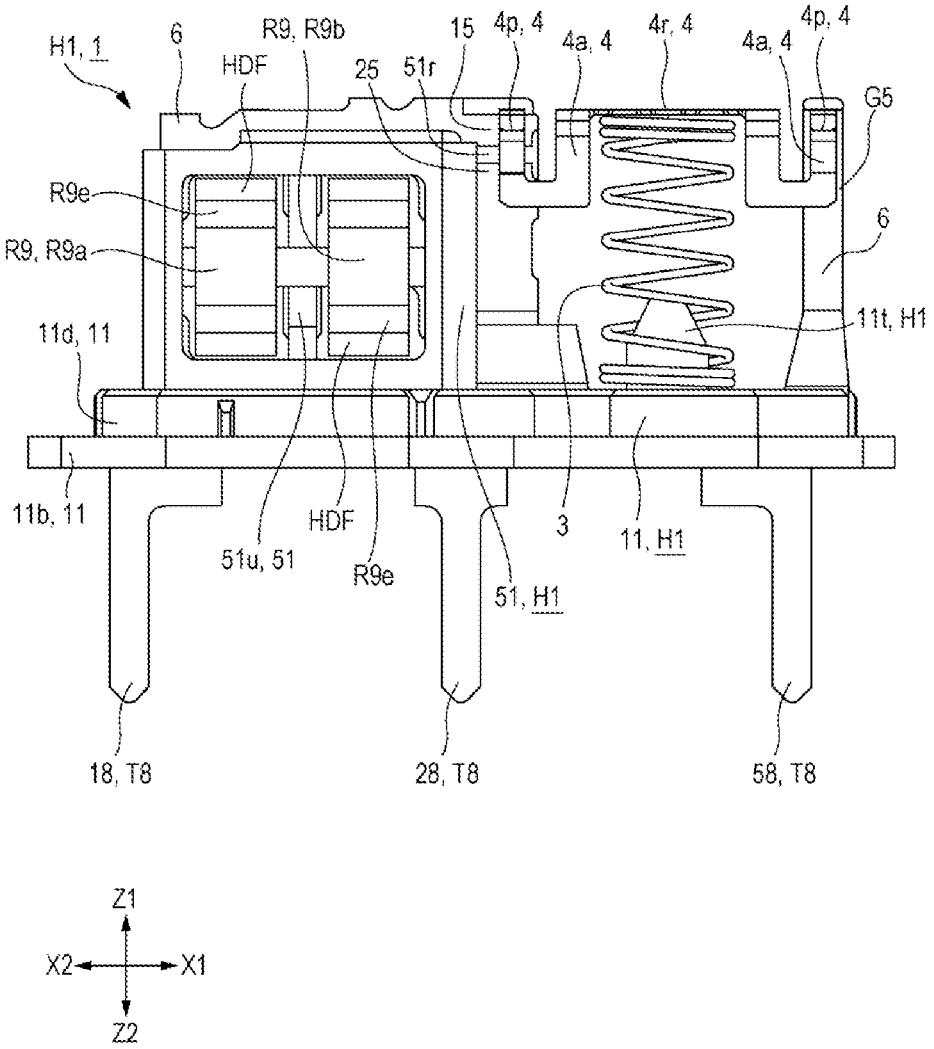
FIG. 8 illustrates the switch device according to the first embodiment of the present invention, and is a front view showing a state where the biasing member, the movable contact, and the resistors are disposed in FIG. 7.

Next, the biasing member 3 of the switch device 100 will be described. FIG. 8 is a front view showing a state where the biasing member 3, the movable contact 4, and the resistors R9 are disposed in the front view of FIG. 7.

The biasing member 3 of the switch device 100 is suitably a general coil spring as shown in FIG. 1 and FIG. 8. As shown in FIG. 8, one end of the biasing member 3 is attached to and supported by the attachment portion lit of the holding member H1, and the other end thereof is in contact with the connection base portion 4*r* of the movable contact 4 (the ceiling surface of the moving member 2). The biasing member 3 elastically biases the moving member 2 and the movable contact 4 toward the upper surface of the case K1 (in the Z1 direction shown in FIG. 8).

As shown in FIG. 8, the biasing member 3 is disposed so as to be between the common fixed contact G5 and the first and second switching fixed contacts 15 and 25. The movable contact 4 can thereby be held in a balanced manner, and the movable contact 4 (contact portions 4*p* described later) can be stably brought into contact with the common fixed contact G5, the first switching fixed contact 15, and the second switching fixed contact 25.

When the operation portion 2*t* is depressed, for example, by an actuator (not shown), the coil spring serving as the biasing member 3 is compressed by the movement of the moving member 2 and the movable contact 4. When the operation portion 2*t* is released from depression, the coil spring pushes back and returns the moving member 2 and the movable contact 4 to the initial state with the accumulated force thereof. The coil spring is a so-called returning member. Although a coil spring is suitably used as the biasing member 3, the present invention is not limited to this. The biasing member 3 only has to have function to return the moving member 2 to the initial state before operation. The biasing member 3 may be, for example, a leaf spring or a rubber member.

Next, the movable contact 4 of the switch device 100 will be described. As shown in FIG. 1, the movable contact 4 of the switch device 100 is a conductive metal plate formed by bending an elastic metal plate, and includes a connection base portion 4*r* formed in a flat plate shape, a pair of opposite elastic arm portions 4*a* connected to the connection base portion 4*r*, and contact portions 4*p* provided at the free distal ends of the pair of elastic arm portions 4*a*. The conductive metal plate is made of copper, iron, or an alloy mainly composed of them, and the surface thereof is plated, for example, with nickel or silver.

As shown in FIG. 8, the pair of elastic arm portions 4*a* of the movable contact 4 are formed at one end and the other end of the connection base portion 4*r*. One of the pair of elastic arm portions 4*a* corresponds to the first switching fixed contact 15 and the second switching fixed contact 25, and the other corresponds to the common fixed contact G5. As shown in FIG. 8, the pair of elastic arm portions 4*a* are formed in a substantially U shape in front view (as seen from the Y2 side of FIG. 1), and their free ends not connected to the connection base portion 4*r* extend in the protruding direction of the operation portion 2*t* (the Z1 direction shown in FIG. 8).

As shown in FIG. 8, in the initial state where the operation portion 2*t* is not operated, the contact portions 4*p* of the movable contact 4 are in contact with the common fixed contact G5 and the first switching fixed contact 15 and out of contact with the second switching fixed contact 25.

Figure 9:
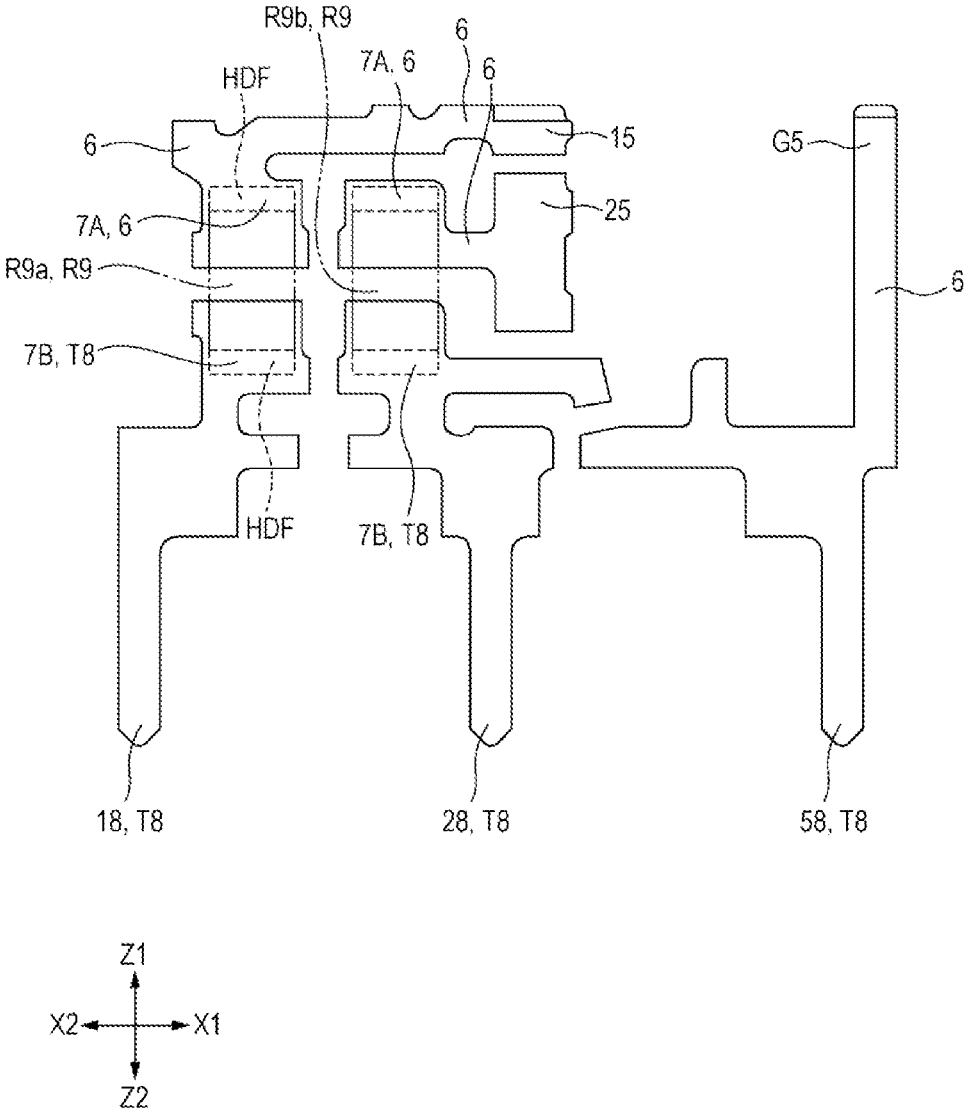
FIG. 9 illustrates the switch device according to the first embodiment of the present invention, and is a front view with the holding member shown in FIG. 7 omitted.

Next, the first switching fixed contact 15, the second switching fixed contact 25, the extending portions 6, and the terminal members T8 of the switch device 100 will be described. FIG. 9 is a front view with the holding member H1 shown in FIG. 7 omitted. For ease of explanation, in FIG. 9, two resistors R9 (resistor R9*a* and resistor R9*b*) are shown in two-dot chain line.

First, the first switching fixed contact 15, the second switching fixed contact 25, the common fixed contact G5, the extending portions 6, and the terminal members T8 of the switch device 100 are made of conductive material such as copper, iron, or an alloy mainly composed of them, by punching a sheet of metal member, so as to have independent shapes as shown in FIG. 9. These are insert-molded before being separated, and are held by the holding member H1. The surface of the metal member is plated, for example, with nickel or silver. The first switching fixed contact 15, the second switching fixed contact 25, the common fixed contact G5, the extending portions 6, and the terminal members T8 are disposed on substantially the same plane.

Next, as shown in FIG. 8, in the initial state where the operation portion 2*t* is not operated, the first switching fixed contact 15 of the switch device 100 is in contact with the contact portion 4*p* of the movable contact 4. Although not shown, the first switching fixed contact 15 comes out of contact with the contact portion 4*p* of the movable contact 4 with the downward operation of the operation portion 2*t*.

Next, as shown in FIG. 8, in the initial state, the second switching fixed contact 25 of the switch device 100 is out of contact with the contact portion 4*p* of the movable contact 4. Although not shown, the second switching fixed contact 25 comes into contact with the contact portion 4*p* of the movable contact 4 with the operation of the operation portion 2*t*, and the switch device 100 is brought to a switched state.

Next, the common fixed contact G5 of the switch device 100 is always in contact with the movable contact 4 in both the initial state shown in FIG. 8 and the switched state where the movable contact 4 is moved with the operation of the operation portion 2*t*.

Next, as shown in FIG. 9, the extending portions 6 of the switch device 100 are formed so as to extend from the common fixed contact G5, the first switching fixed contact 15, and the second switching fixed contact 25. As shown in FIG. 9, some of the extending portions 6 have fixing portions 7A to which the electrode portions R9*e* of the resistors R9 are soldered. The extending portions 6 having the fixing portions 7A are held by the holding wall portion 51 of the holding member H1 with the fixing portions 7A exposed.

Finally, as shown in FIG. 9, the terminal members T8 of the switch device 100 extend from the bottom wall portion 11 to the outside and includes a first terminal 18 electrically connected to the first switching fixed contact 15 through the resistor R9*a*, a second terminal 28 electrically connected to the second switching fixed contact 25 through the resistor R9*b*, and a common terminal 58 electrically connected to the common fixed contact G5.

As shown in FIG. 9, some of the terminal members T8 (the first terminal 18 and the second terminal 28) have fixing portions 7B to which the electrode portions R9*e* of the resistors R9 are soldered. The first terminal 18 and the second terminal 28 are held by the holding wall portion 51 of the holding member H1 with the fixing portions 7B exposed.

Since the fixing portions 7A provided in the extending portions 6 and the fixing portions 7B provided in the terminal members T8 are exposed in the frame-like inner part of the holding wall portion 51 and are held by the holding wall portion 51, when placing the resistors R9*a* and R9*b* on their respective fixing portions 7A and 7B and performing soldering, soldering such as reflow soldering can be performed. That is, since the holding wall portion 51 holding the fixing portions 7A and 7B is formed of the first synthetic resin material having heat resistance, the holding wall portion 51 can withstand the temperature of soldering such as reflow soldering, and the resistors R9 can be reliably soldered to the fixing portions 7A and 7B.

In the first embodiment of the present invention, as shown in FIG. 2B, a part of each terminal member T8 is surrounded, throughout its circumference, by the second synthetic resin material forming the bottom wall portion 11. Therefore, each terminal member T8 can adhere, throughout its circumference, to the bottom wall portion 11. Therefore, water and the like can be prevented from entering through the gap between each terminal member T8 and the bottom wall portion 11. In addition, since the switch device 100 is formed by assembling and integrating the case K1 and the holding member H1, and the holding wall portion 51 is disposed in a sealed housing space formed by the case K1 and the bottom wall portion 11, the waterproof performance of the switch device 100 can be improved.

Next, the resistors R9 of the switch device 100 will be described. Two inexpensive general-purpose chip resistors are used as the resistors R9 of the switch device 100, and chip resistors having different resistance values are selected as the resistor R9*a* and R9*b*. The two resistors R9 (resistors R9*a* and R9*b*) are each soldered to the fixing portions 7A and 7B corresponding to two electrode portions R9*e*. The first switching fixed contact 15 and the first terminal 18 that are separated from each other, and the second switching fixed contact 25 and the second terminal 28 that are separated from each other are thereby electrically connected by the resistors R9*a* and R9*b*. Although chip resistors are suitably used as the resistors R9, the present invention is not limited to this. The resistors R9 may each be, for example, a substrate on which a carbon resistor is printed.

Figure 10:
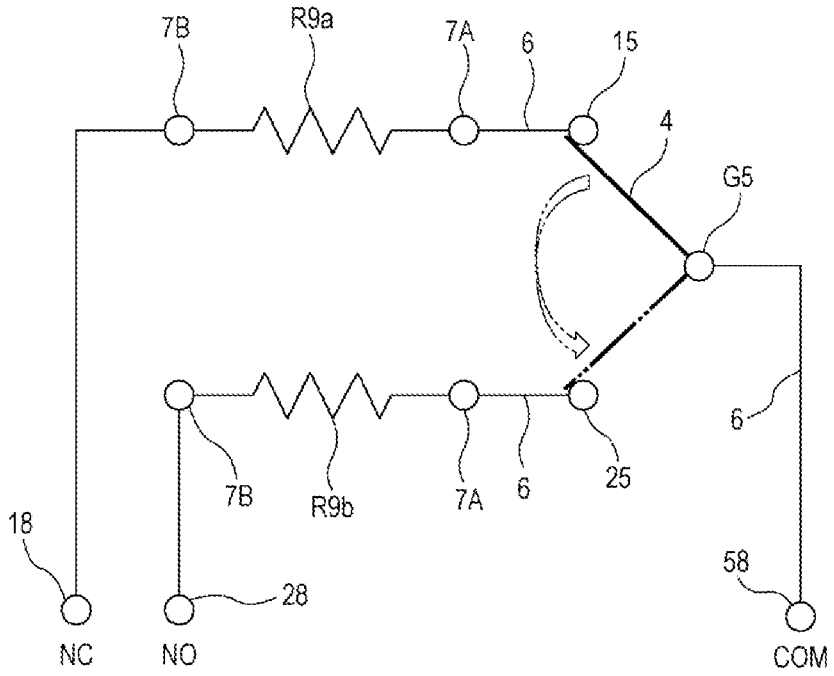
FIG. 10 is a detection circuit diagram of the switch device according to the first embodiment of the present invention.

Finally, a detection circuit of the switch device 100 according to the first embodiment of the present invention will be described. FIG. 10 is a detection circuit diagram of the switch device 100. FIG. 10 shows the initial state where the operation portion 2*t* is not operated. For ease of explanation, parts corresponding to components of the switch device 100 are indicated with dashed lines.

As shown in FIG. 10, in the detection circuit of the switch device 100, the common fixed contact G5 connected to the common terminal 58 through the extending portion 6 is connected through the movable contact 4 to the first switching fixed contact 15 in the initial state where the operation portion 2*t* is not operated. The first switching fixed contact 15 is connected through the resistor R9*a* to the first terminal 18. At that time, one end of the resistor R9*a* is connected to the fixing portion 7A of the extending portion 6, and the other end of the resistor R9*a* is connected to the fixing portion 7B of the first terminal 18 (terminal member T8).

On the other hand, in the initial state, the second switching fixed contact 25 is not connected to the common fixed contact G5, and is connected through the resistor R9*b* to the second terminal 28. At that time, one end of the resistor R9*b* is connected to the fixing portion 7A of the extending portion 6, and the other end of the resistor R9*b* is connected to the fixing portion 7B of the second terminal 28 (terminal member T8).

When the operation portion 2*t* is operated by depressing operation, the movable contact 4 moves with the movement of the moving member 2, and the movable contact 4 is thereby connected to the second switching fixed contact 25. That is, the switch device 100 is brought to the switched state. When the operation portion 2*t* is released from depression, as described above, the movable contact 4 is pushed back to the initial state by the biasing member 3 (returning member). In this way, the switch device 100 is switched between the initial state and the switched state.

In this detection circuit, in the initial state, the resistance value of the resistor R9*a* is detected between the first terminal 18 and the common terminal 58, and open (infinite) resistance value is detected between the second terminal 28 and the common terminal 58. On the other hand, in the switched state, open (infinite) resistance value is detected between the first terminal 18 and the common terminal 58, and the resistance value of the resistor R9*b* is detected between the second terminal 28 and the common terminal 58. The on/off of the switch can thereby be detected.

In this detection circuit, when a wire or the like of an external device connected is in an open circuit state, for example, the voltage from the external device is not applied to the common terminal 58, regardless of the connection state of the movable contact 4 (the resistance value as the detection circuit is seen from the external device is detected to be infinite). On the other hand, when the wire or the like of the external device is in a short circuit state, the voltage of power source supplied to the external device is applied to the common terminal 58, regardless of the connection state of the movable contact 4 (the resistance value as the detection circuit is seen from the external device is detected to be zero).

In this detection circuit, when the external device connected is in a normal state, for example, different voltage values are detected at the common terminal 58 depending on the connection state of the movable contact 4. That is, in the initial state, a voltage corresponding to the resistance value of the resistor R9*a* and the resistance value of the external device is applied to the common terminal 58, and in the switched state, a voltage corresponding to the resistance value of the resistor R9*b* and the resistance value of the external device is applied to the common terminal 58. Thus, by detecting the voltage (resistance value) of this detection circuit, it can be detected whether the connection between the external device and the wire is normal or abnormal.

Advantageous effects of the thus configured switch device 100 of the first embodiment of the present invention will be summarized below.

Since, in the switch device 100 of the first embodiment of the present invention, the holding wall portion 51 holding the fixing portions 7A and 7B is formed of the first synthetic resin material having heat resistance, during soldering such as reflow soldering, the holding wall portion 51 can withstand the temperature of soldering such as reflow soldering, and the resistors R9 can be reliably soldered to the fixing portions 7A and 7B. On the other hand, since the switch device 100 has the bottom wall portion 11 of the holding member H1 separately from the holding wall portion 51 of the holding member H1, the bottom wall portion 11 can be made of inexpensive material that need not withstand the temperature during soldering. The cost of the switch device 100 can thereby be suppressed.

Since a part of each terminal member T8 is surrounded, throughout its circumference, by the second synthetic resin material forming the bottom wall portion 11, each terminal member T8 can adhere, throughout its circumference, to the bottom wall portion 11. Therefore, water and the like can be prevented from entering through the gap between each terminal member T8 and the bottom wall portion 11.

Since the holding wall portion 51 is disposed in a housing space formed by the case K1 and the bottom wall portion 11, a part of the holding wall portion 51 is not exposed outside the housing 1, and the joint (interface) between the holding wall portion 51 and the bottom wall portion 11 and the joint between the holding wall portion 51 and the case K1 are not exposed to the outside. Therefore, only the joint between the case K1 and the bottom wall portion 11 is exposed to the outside, and it is not necessary to consider the adhesion between the holding wall portion 51 and the bottom wall portion 11 and between the holding wall portion 51 and the case K1. Therefore, the degree of freedom of selection of synthetic resin material of the holding wall portion 51 can be improved.

Since the embedded portions 51*m* provided in the lower part of the holding wall portion 51 are each provided with an engaging portion 51*k* formed such that the lower part thereof is larger than the upper part thereof, and the engaging portions 51*k* are embedded in the bottom wall portion 11, even when the holding wall portion 51 is formed of the first synthetic resin material, and the bottom wall portion 11 is formed of the second synthetic resin material different from the first synthetic resin material, the firmness of engagement (adhesion) therebetween can be improved. Therefore, for example, in the assembly step, the holding wall portion 51 and the bottom wall portion 11 can be easily handled as an integrated component.

Since the case K1 is formed of the third synthetic resin material having a heat distortion temperature lower than that of the first synthetic resin material, the case K1 can be made of inexpensive material that need not withstand the temperature during soldering. Therefore, the cost of the switch device 100 can be further suppressed.

Since the second synthetic resin material and the third synthetic resin material are the same type of material, when integrating the holding member H1 (bottom wall portion 11) and the case K1, laser welding can be suitably used. Therefore, the holding member H1 and the case K1 can be easily integrated, and the adhesion and joint strength between the holding member H1 and the case K1 can be improved. Therefore, the airtightness between the holding member H1 and the case K1 can be improved, and the cost of the switch device 100 can be further suppressed.

Next, a method for manufacturing the switch device 100 in the first embodiment of the present invention will be described.

Figure 11:
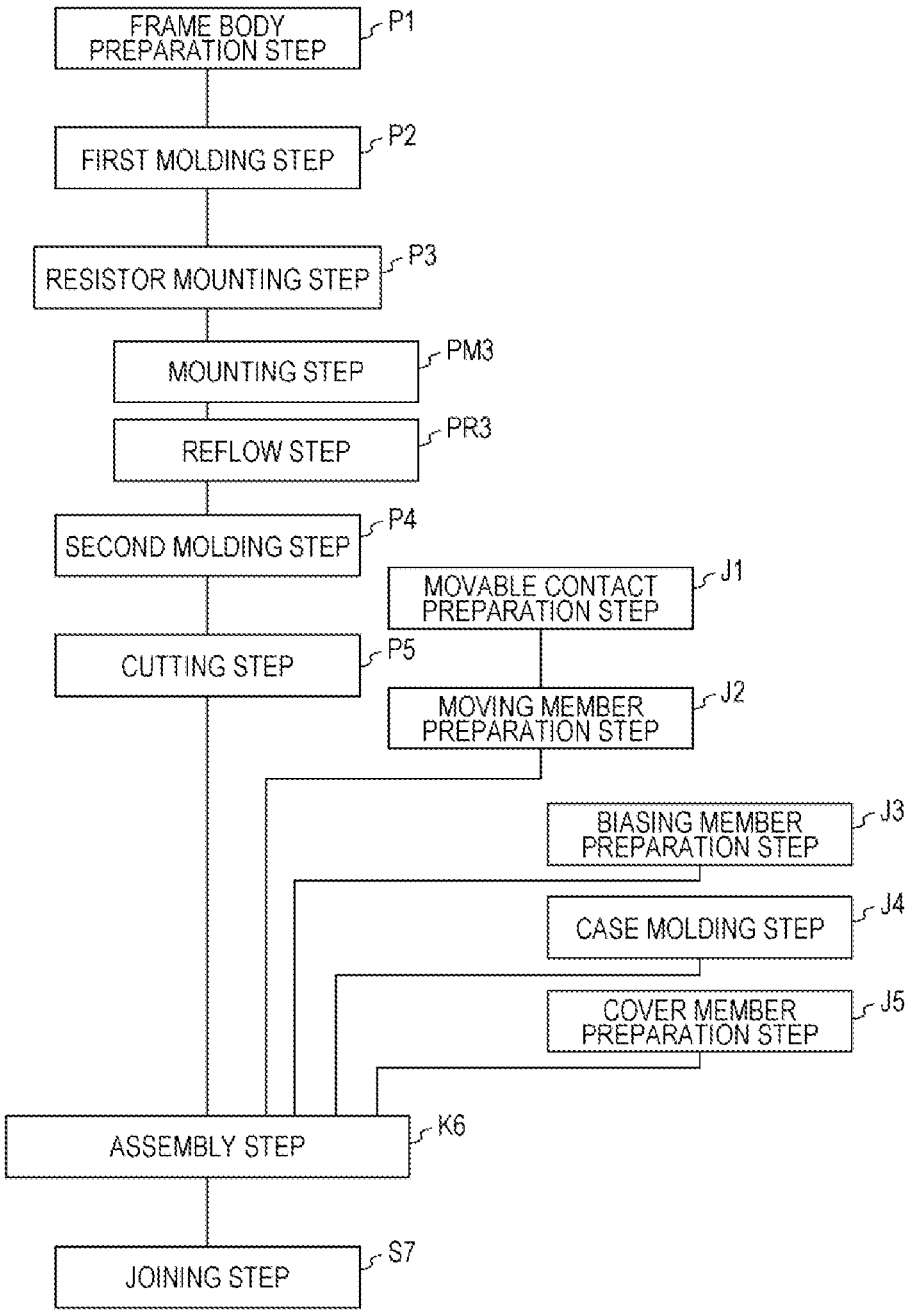
FIG. 11 illustrates a method for manufacturing the switch device according to the first embodiment of the present invention, and illustrates each manufacturing step.
Figure 12A:
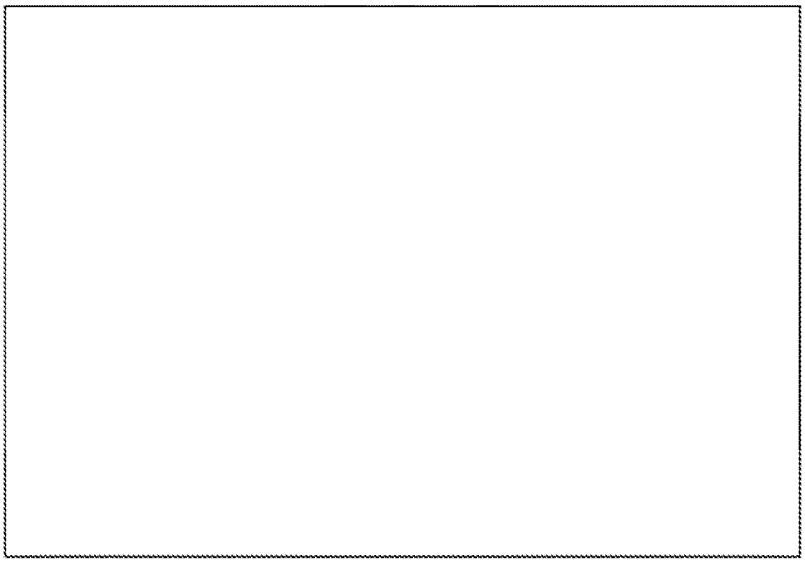
FIGS. 12A and 12B are front views illustrating a frame body preparation step of the method for manufacturing the switch device according to the first embodiment of the present invention.
Figure 12B:
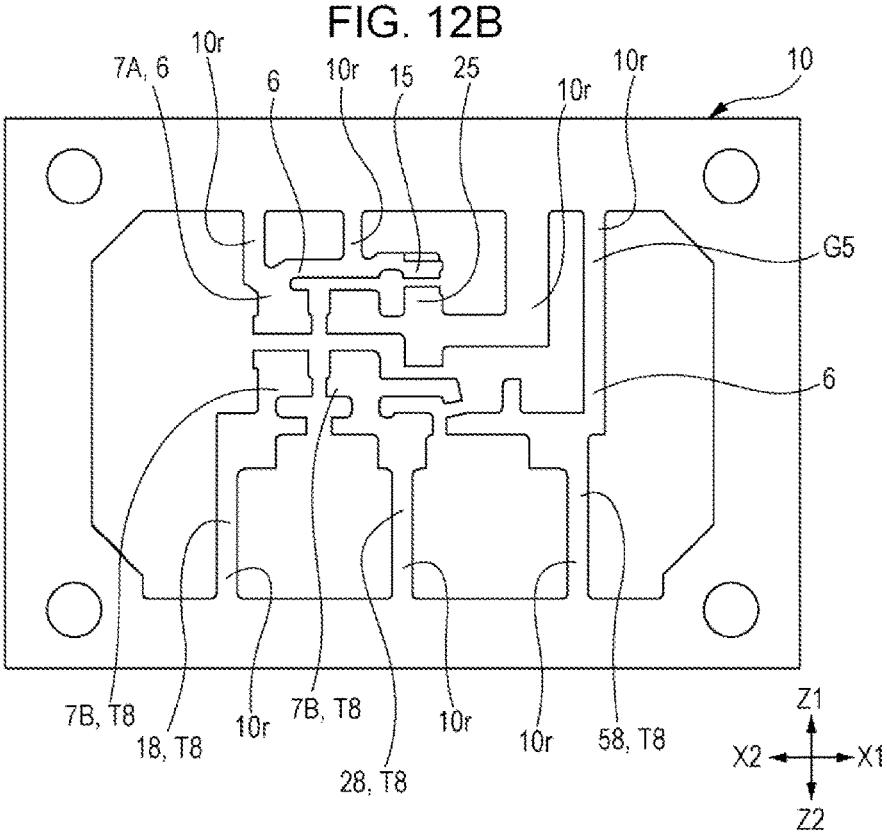
Figure 13:
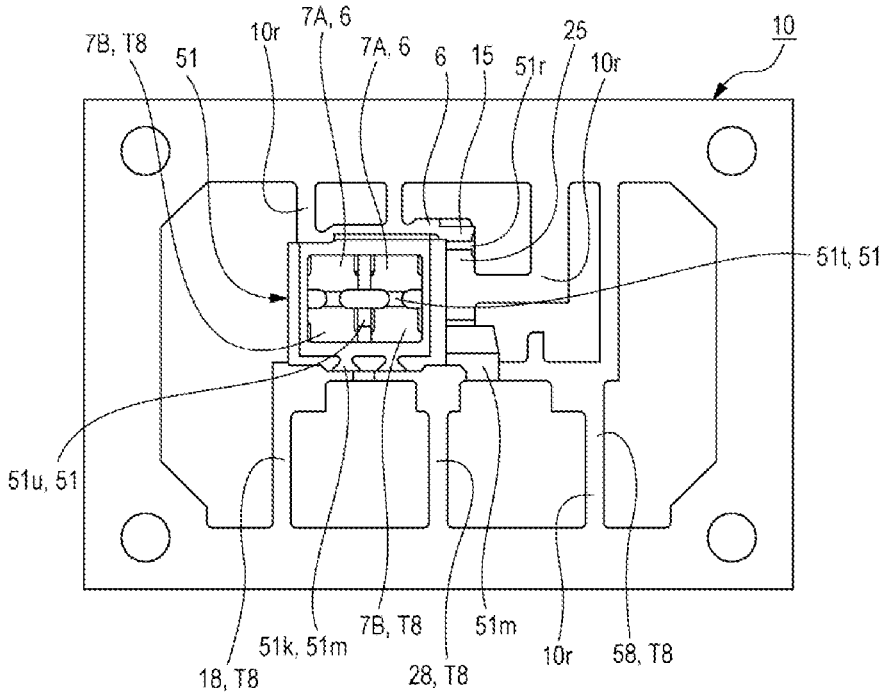
FIG. 13 is a front view illustrating a first molding step of the method for manufacturing the switch device according to the first embodiment of the present invention.
Figure 14A:
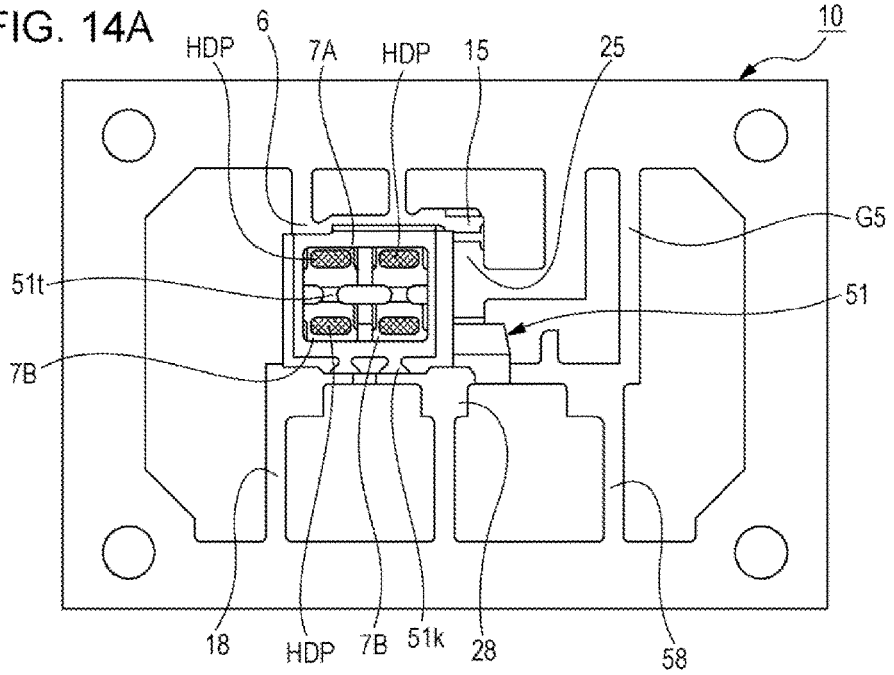
FIGS. 14A and 14B are front views illustrating a resistor mounting step of the method for manufacturing the switch device according to the first embodiment of the present invention.
Figure 14B:
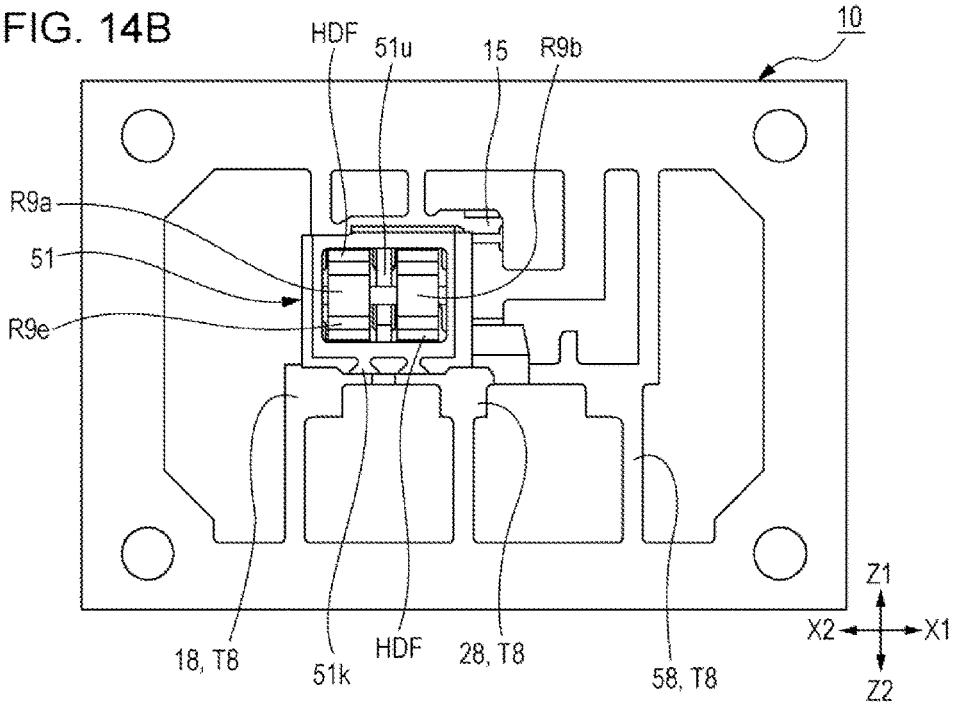
Figure 15A:
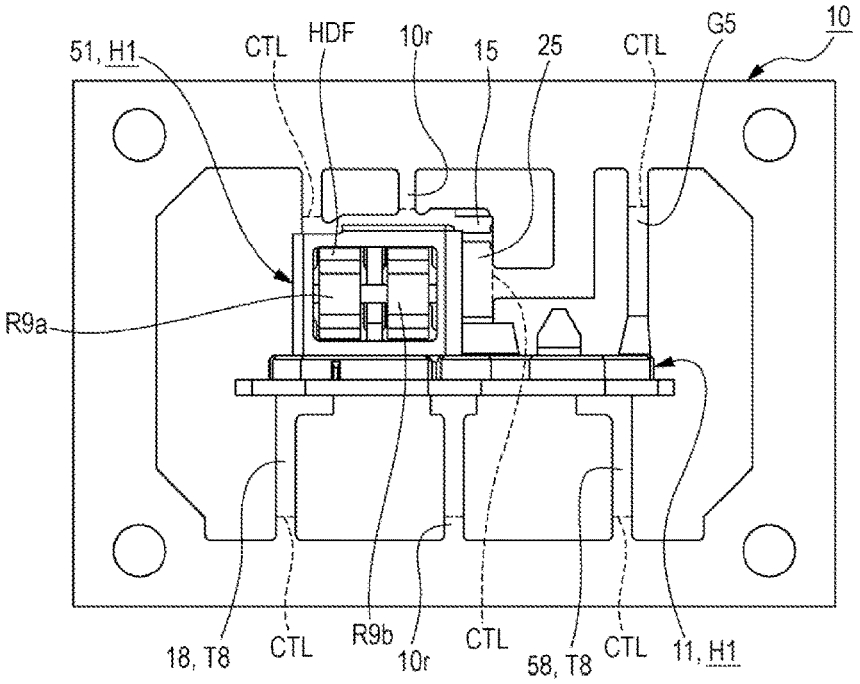
FIGS. 15A and 15B illustrate the method for manufacturing the switch device according to the first embodiment of the present invention.
Figure 15B:
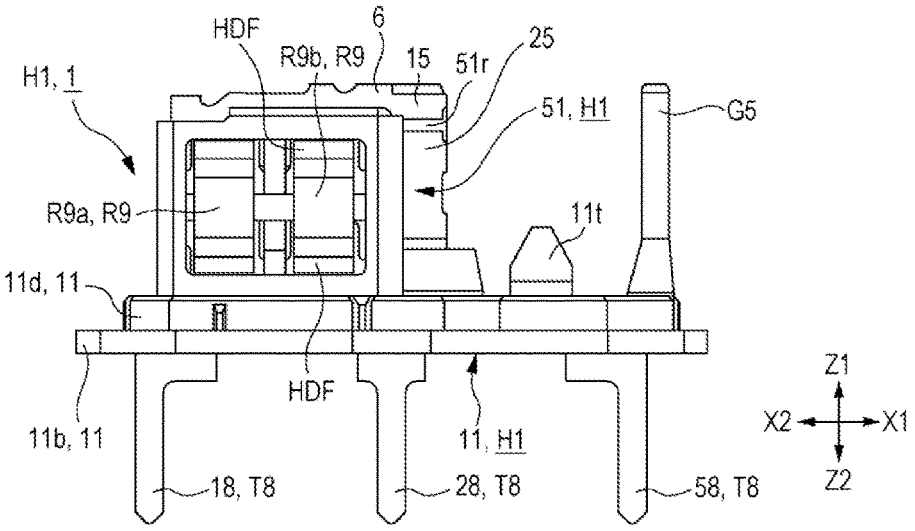

FIG. 11 illustrates a method for manufacturing the switch device 100 according to the first embodiment of the present invention, and illustrates each manufacturing step. FIGS. 12A and 12B are front views illustrating a frame body preparation step P1, FIG. 12A shows a metal member before processing, and FIG. 12B shows a state where the frame body preparation step P1 is finished. FIG. 13 is a front view illustrating a first molding step P2, and shows a state where the first molding step P2 is finished. FIGS. 14A and 14B are front views illustrating a resistor mounting step P3, FIG. 14A shows a state where solder paste HDP is applied to fixing portions 7A and 7B, and FIG. 14B shows a state where a reflow step PR3 is finished. In FIG. 14A, for ease of explanation, solder paste HDP is cross-hatched. FIG. 15A is a front view illustrating a second molding step P4, and shows a state where the second molding step P4 is finished. FIG. 15B is a front view illustrating a cutting step P5, and shows a state where the cutting step P5 is finished. Although, in FIG. 12A to FIG. 15B, for ease of understanding, one frame body 10 is shown, a so-called hoop-like frame body such that a plurality of frame bodies are joined together to form a continuous band may be used.

As shown in FIG. 11, the method for manufacturing the switch device 100 in the first embodiment of the present invention mainly includes a frame body preparation step P1 in which a frame body 10 is prepared to which terminal members T8 and others are connected by connecting portions 10*r*, a first molding step P2 in which a holding wall portion 51 is formed, a resistor mounting step P3 in which resistors R9 are soldered, a second molding step P4 in which a bottom wall portion 11 is formed, and a cutting step P5 in which the connecting portions 10*r* are cut. As shown in FIG. 11, the method for manufacturing the switch device 100 further includes an assembly step K6 in which members passed through each step are assembled, and a joining step S7 in which after the assembly step K6, a holding member H1 and a case K1 are joined together.

First, in the frame body preparation step P1, as shown in FIG. 12A, a conductive metal plate made of conductive material such as copper, iron, or an alloy mainly composed of them is prepared. Then, punching is performed on this conductive metal plate using a die. Thus, in the frame body preparation step P1, as shown in FIG. 12B, a frame body 10 is prepared to which a part of each of a common fixed contact G5, a first switching fixed contact 15, a second switching fixed contact 25, extending portions 6, and terminal members T8 is connected by a connecting portion 10*r*. The frame body 10 that is a metal member is provided with fixing portions 7A and 7B required in the subsequent resistor mounting step P3. Needless to say, the frame body preparation step P1 must be performed before the subsequent first molding step P2.

Next, in the first molding step P2, the frame body 10 that is a metal member is insert-molded using a first synthetic resin material having heat resistance, and as shown in FIG. 13, a rectangular frame-like holding wall portion 51 is formed so as to sandwich the metal member. At that time, the holding wall portion 51 is formed such that the surfaces of the fixing portions 7A and 7B are exposed in the frame-like inner part of the holding wall portion 51.

Similarly, when forming the holding wall portion 51, as shown in FIG. 13, the holding wall portion 51 is formed such that the surfaces of the first switching fixed contact 15 and the second switching fixed contact 25 are exposed in the frame-like outer part of the holding wall portion 51. At that time, an insulating portion 51*r* of the holding wall portion 51 is disposed between the first switching fixed contact 15 and the second switching fixed contact 25, and the first switching fixed contact 15 and the second switching fixed contact 25 are fixed. The extending portions 6 and the terminal members T8 are partially embedded in the holding wall portion 51 and fixed.

As shown in FIG. 13, embedded portions 51*m* that are embedded in the bottom wall portion 11 formed in the second molding step P4 are formed in the holding wall portion 51, and an engaging portion 51*k* having a shape such that the lower part thereof is larger than the upper part thereof is formed in each of the embedded portions 51*m*. Just by insert-molding the frame body 10 using the first synthetic resin material, the holding wall portion 51 having many functions can be easily made. When thermoplastic synthetic resin material such as polyamide resin (PA) or polyphenylenesulfide resin (PPS) is used as the first synthetic resin material, the holding wall portion 51 can be formed by injection molding, more easily and inexpensively.

Next, as shown in FIG. 11, the resistor mounting step P3 includes a mounting step PM3 in which resistors R9 are mounted on the fixing portions 7A and 7B, and a reflow step PR3 in which the resistors R9 are soldered to the fixing portions 7A and 7B.

First, in the mounting step PM3 of the resistor mounting step P3, as shown in FIG. 14A, solder paste HDP is applied to parts of the fixing portions 7A and 7B held by the holding wall portion 51. Next, two resistors R9*a* and R9*b* are mounted on the parts to which solder paste HDP is applied. At that time, solder paste HDP is interposed between the electrode portions R9*e* of the resistors R9 (resistors R9*a* and R9*b*) and the fixing portions 7A and 7B. A dispenser device is suitably used for applying solder paste HDP, and a surface mounting device is suitably used for mounting the resistors R9.

Next, in the reflow step PR3 of the resistor mounting step P3, the frame body 10 on which the resistors R9 are mounted is loaded into a reflow furnace, and solder paste HDP provided between the electrode portions R9*e* of the resistors R9 and the fixing portions 7A and 7B is heated. The resistors R9 are thereby soldered and fixed to the fixing portions 7A and 7B as shown in FIG. 14B.

At this time, since the holding wall portion 51 formed in the first molding step P2 is formed of the first synthetic resin material having heat resistance that can withstand the temperature during soldering, the resistors R9 can be reliably soldered to the fixing portions 7A and 7B by high-temperature heating. Moreover, since soldering is performed using a reflow furnace in the reflow step PR3, the resistors R9 can be soldered to the fixing portions 7A and 7B with high productivity. "Having heat resistance" means having heat resistance such that when soldering the resistors R9, the holding wall portion 51 (first synthetic resin material) is neither thermally deformed nor melted. When a reflow furnace is used, "having heat resistance" means having heat resistance such that when exposed to the reflow temperature (generally 220° C. to 250° C.) for a short time (30 to 40 seconds), the holding wall portion 51 is neither thermally deformed nor melted.

Next, in the second molding step P4, the frame body 10 passed through the resistor mounting step P3 is insert-molded, and as shown in FIG. 15A, a bottom wall portion 11 is formed such that the terminal members T8 located on the lower side of the holding wall portion 51 are embedded therein. At that time, the bottom wall portion 11 is formed such that the embedded portions 51*m* formed in the lower part of the holding wall portion 51 are embedded therein. Since the bottom wall portion 11 is not exposed to high temperature by soldering in the subsequent steps, a second synthetic resin material having a heat distortion temperature lower than that of the first synthetic resin material can be used as synthetic resin material of the bottom wall portion 11. Therefore, the bottom wall portion 11 can be made of inexpensive synthetic resin material that need not withstand the temperature during soldering, and this manufacturing method can suppress the cost of the switch device 100.

In the second molding step P4, when forming the bottom wall portion 11, the engaging portions 51*k* formed in the embedded portions 51*m* of the holding wall portion 51 (formed in the first molding step P2) are embedded in the bottom wall portion 11. Therefore, after the second molding step P4, even when the bottom wall portion 11 is formed of the second synthetic resin material, and the holding wall portion 51 is formed of the first synthetic resin material different from the second synthetic resin material, the firmness of engagement (adhesion) therebetween can be improved. Therefore, for example, in the assembly step, the holding wall portion 51 and the bottom wall portion 11 can be easily handled as an integrated component. For example, even if the holding wall portion 51 and the bottom wall portion 11 are subjected to shock due to dropping or the like, they are not separated. The productivity of the switch device 100 can thereby be improved.

In the second molding step P4, when forming the bottom wall portion 11, the bottom wall portion 11 is formed such that a part of each terminal member T8 is surrounded, throughout its circumference, by the second synthetic resin material of the bottom wall portion 11. Therefore, each terminal member T8 can adhere, throughout its circumference, to the bottom wall portion 11. Therefore, water and the like can be prevented from entering through the gap between each terminal member T8 and the bottom wall portion 11.

In the second molding step P4, when forming the bottom wall portion 11, the bottom wall portion 11 is formed such that the holding wall portion 51 is not exposed on the lower side of the bottom wall portion 11. Therefore, a part of the holding wall portion 51 is not exposed outside the housing 1. Therefore, the joint between the holding wall portion 51 and the bottom wall portion 11 and the joint between the holding wall portion 51 and the case K1 are not exposed to the outside, and only the joint between the case K1 and the bottom wall portion 11 is exposed to the outside. Therefore, it is not necessary to consider the adhesion between the holding wall portion 51 and the bottom wall portion 11 and between the holding wall portion 51 and the case K1, and the degree of freedom of selection of synthetic resin material of the holding wall portion 51 can be improved.

Next, in the cutting step P5, after the second molding step P4, the parts of cut lines CTL shown by dashed lines in FIG. 15A are cut by press working or the like, and the main body part shown in FIG. 15B is separated from the connecting portions 10*r* of the frame body 10. The integrated component in which contacts and terminals are held by the holding member H1 can thereby be separated easily and as desired.

Before the cutting step P5, since the frame body 10 prepared in the frame body preparation step P1 is handled, the insert molding in the first molding step P2, the soldering in the resistor mounting step P3, and the insert molding in the second molding step P4 can be easily performed.

Next, the assembly step K6 in which components are assembled is performed. In the assembly step K6, as shown in FIG. 11, assembly is performed using the integrated component made in steps P1 to P5, the movable contact 4 made in the movable contact preparation step J1, the moving member 2 made in the moving member preparation step J2, the biasing member 3 made in the biasing member preparation step J3, the case K1 made in the case molding step J4, and the cover member C2 made in the cover member preparation step J5.

First, one end of a coil spring that is the biasing member 3 is attached and fixed to the attachment portion lit of the bottom wall portion 11 in the integrated component (see FIG. 15B).

Next, the movable contact 4 is housed in the substantially U-shaped recessed portions 2*r* of the moving member 2, and the connection base portion 4*r* of the movable contact 4 is fixed to the ceiling surface of the recessed portion 2*r* by caulking or the like. Then, the movable contact 4 is disposed such that the connection base portion 4*r* of the movable contact 4 is in contact with the other end of the coil spring (biasing member 3), and the movable contact 4 is assembled such that a pair of elastic arm portions 4*a* (contact portions 4*p*) provided at one end of the connection base portion 4*r* of the movable contact 4 sandwich the first switching fixed contact 15, and a pair of elastic arm portions 4*a* (contact portions 4*p*) provided at the other end of the connection base portion 4*r* sandwich the common fixed contact G5.

Next, the case K1 is disposed so as to cover and house the upper surface side of the holding member H1. At that time, the operation shaft portion 2*j* of the moving member 2 is passed through the through portion K1*h* of the case K1 such that the operation shaft portion 2*j* protrudes above the case K1.

In the case molding step J4 in which the case K1 is formed, since the case K1 is not exposed to high temperature by soldering in the subsequent steps, a third synthetic resin material having a heat distortion temperature lower than that of the first synthetic resin material can be used as synthetic resin material of the case K1. Therefore, the case K1 can be made of inexpensive synthetic resin material that need not withstand the temperature during soldering, and the cost of the switch device 100 can be suppressed.

Next, by assembling the cover member C2, the assembly step K6 is finished. The cover member C2 is disposed on the upper surface of the case K1 so as to cover the through portion K1*h* of the case K1. At that time, the flange portion C2*v* of the cover member C2 is engaged with the groove portion K1*m* of the case K1, and the through-hole C2*h* of the cover member C2 is engaged with the recessed joint part between the operation shaft portion 2*j* and the operation portion 2*t*. The flange portion C2*v* may be firmly fixed to the case K1 by inwardly deforming the ring-like resin wall portion around the opening of the case K1 by caulking. Alternatively, the flange portion C2*v* may be firmly fixed to the case K1 by applying adhesive to the flange portion C2*v* and the resin wall portion and hardening the adhesive.

Finally, the joining step S7 is performed, and the switch device 100 shown in FIGS. 2A and 2B is completed. In the joining step S7, the bottom wall portion 11 of the holding member H1 and the case K1 are integrated. Laser welding is suitably used for this integration. By using laser welding, the holding member H1 (bottom wall portion 11) and the case K1 can be easily integrated, and the adhesion and joint strength between the holding member H1 and the case K1 can be improved. In particular, since the second synthetic resin material forming the bottom wall portion 11 of the holding member H1 and the third synthetic resin material forming the case K1 are the same type of material, the adhesion and joint strength can be further improved.

Since the adhesion and joint strength between the holding member H1 and the case K1 can be improved, the airtightness of the housing 1 can be improved.

Advantageous effects of the thus configured method for manufacturing the switch device 100 of the first embodiment of the present invention will be summarized below.

In the method for manufacturing the switch device 100 of the first embodiment of the present invention, the holding wall portion 51 formed in the first molding step P2 is formed of the first synthetic resin material having heat resistance. Therefore, in the resistor mounting step P3, the resistors R9 can be reliably soldered to the fixing portions 7A and 7B by high-temperature heating. In the second molding step P4, the bottom wall portion 11 can be formed using the second synthetic resin material having a heat distortion temperature lower than that of the first synthetic resin material. Therefore, the bottom wall portion 11 can be made of inexpensive material that need not withstand the temperature during soldering, and this manufacturing method can suppress the manufacturing cost of the switch device 100.

Since the resistor mounting step P3 includes the reflow step PR3, the resistors R9 can be soldered to the fixing portions 7A and 7B with high productivity.

Since, in the second molding step P4, the bottom wall portion 11 is formed such that a part of each terminal member T8 is surrounded, throughout its circumference, by the second synthetic resin material, each terminal member T8 can adhere, throughout its circumference, to the bottom wall portion 11. Therefore, water and the like can be prevented from entering through the gap between each terminal member T8 and the bottom wall portion 11.

In the second molding step P4, the bottom wall portion 11 is formed such that the holding wall portion 51 is not exposed on the lower side of the bottom wall portion 11. Therefore, a part of the holding wall portion 51 is not exposed outside the housing 1. Therefore, the joint between the holding wall portion 51 and the bottom wall portion 11 and the joint between the holding wall portion 51 and the case K1 are not exposed to the outside, and only the joint between the case K1 and the bottom wall portion 11 is exposed to the outside. Therefore, it is not necessary to consider the adhesion between the holding wall portion 51 and the bottom wall portion 11 and between the holding wall portion 51 and the case K1, and the degree of freedom of selection of synthetic resin material of the holding wall portion 51 can be improved.

In the second molding step P4, the bottom wall portion 11 is formed such that the engaging portions 51*k* of the holding wall portion 51 formed in the first molding step P2 are embedded in the bottom wall portion 11. Therefore, after the second molding step P4, even when the bottom wall portion 11 is formed of the second synthetic resin material, and the holding wall portion 51 is formed of the first synthetic resin material different from the second synthetic resin material, the firmness of engagement (adhesion) therebetween can be improved. Therefore, for example, in the assembly step, the holding wall portion 51 and the bottom wall portion 11 can be easily handled as an integrated component. For example, even if the holding wall portion 51 and the bottom wall portion 11 are subjected to shock due to dropping or the like, they are not separated. The productivity of the switch device 100 can thereby be improved.

Before the cutting step P5, since the frame body 10 prepared in the frame body preparation step P1 is handled, the insert molding in the first molding step P2, the soldering in the resistor mounting step P3, and the insert molding in the second molding step P4 can be easily performed. Then, by cutting the connecting portions 10*r* in the subsequent cutting step P5, the integrated component in which contacts and terminals are held by the holding member H1 can be separated easily and as desired. The switch device 100 can thereby be manufactured (made) with high productivity.

Since the case K1 is formed of the third synthetic resin material having a heat distortion temperature lower than that of the first synthetic resin material, it is not necessary to use expensive synthetic resin material having heat resistance. Therefore, the manufacturing cost of the switch device can be further suppressed. Since the second synthetic resin material and the third synthetic resin material are the same type of material, when integrating the holding member H1 (bottom wall portion 11) and the case K1, laser welding can be suitably used. Therefore, the holding member H1 and the case K1 can be easily integrated, and the adhesion and joint strength between the holding member H1 and the case K1 can be improved. The airtightness of the housing 1 is thereby improved, and the manufacturing cost of the switch device 100 can be further suppressed.

Second Embodiment

Next, a switch device 200 according to a second embodiment of the present invention will be described. The switch device 200 according to the second embodiment of the present invention differs from the first embodiment mainly in the configuration of the first switching fixed contact 35, the second switching fixed contact 45, and the terminal members T8. The same reference numerals will be used to designate the same components as those in the first embodiment, and the detailed description thereof will be omitted. Because the method for manufacturing the switch device 200 is the same as the method for manufacturing the switch device 100 of the first embodiment, the description thereof will be omitted.

Figure 16:
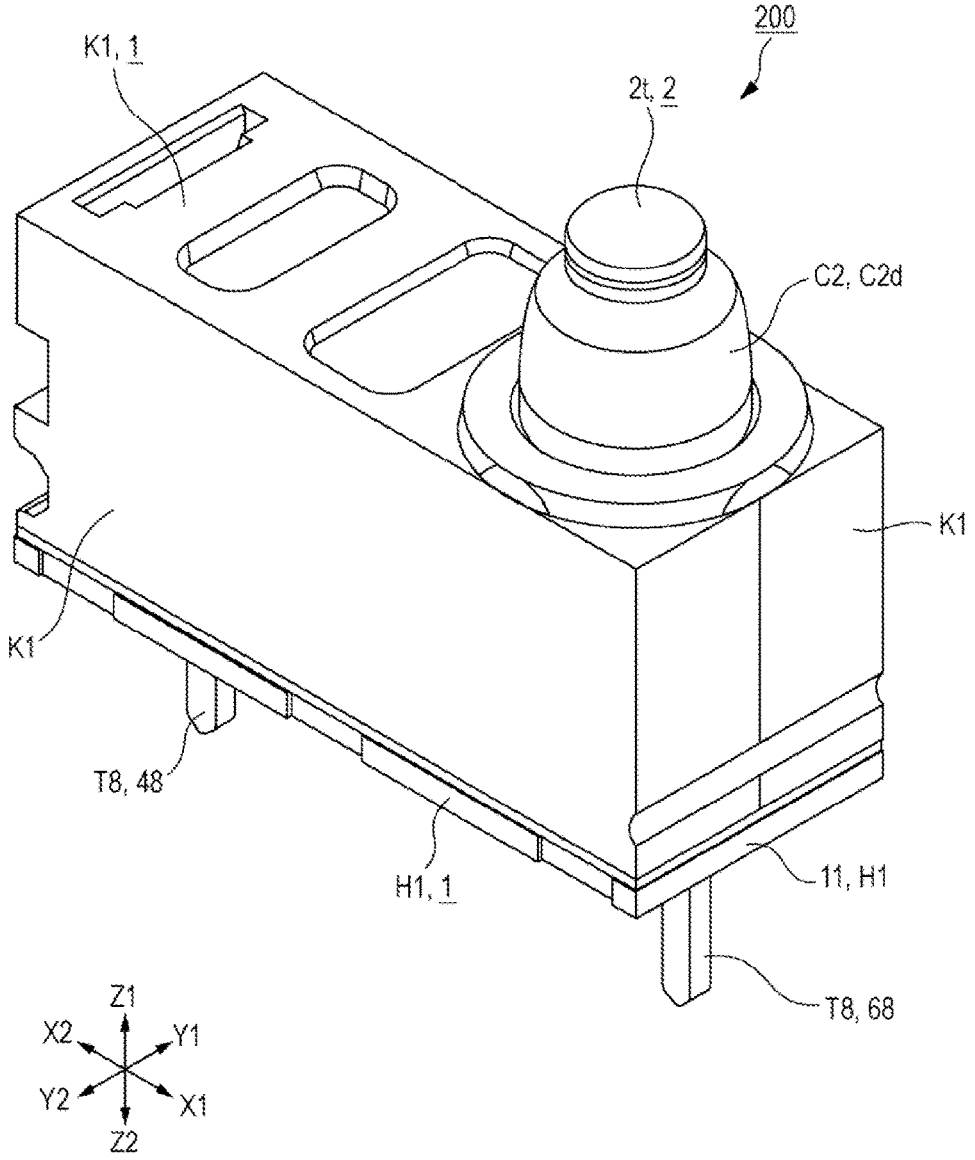
FIG. 16 is a perspective view of a switch device according to a second embodiment of the present invention.
Figure 17A:
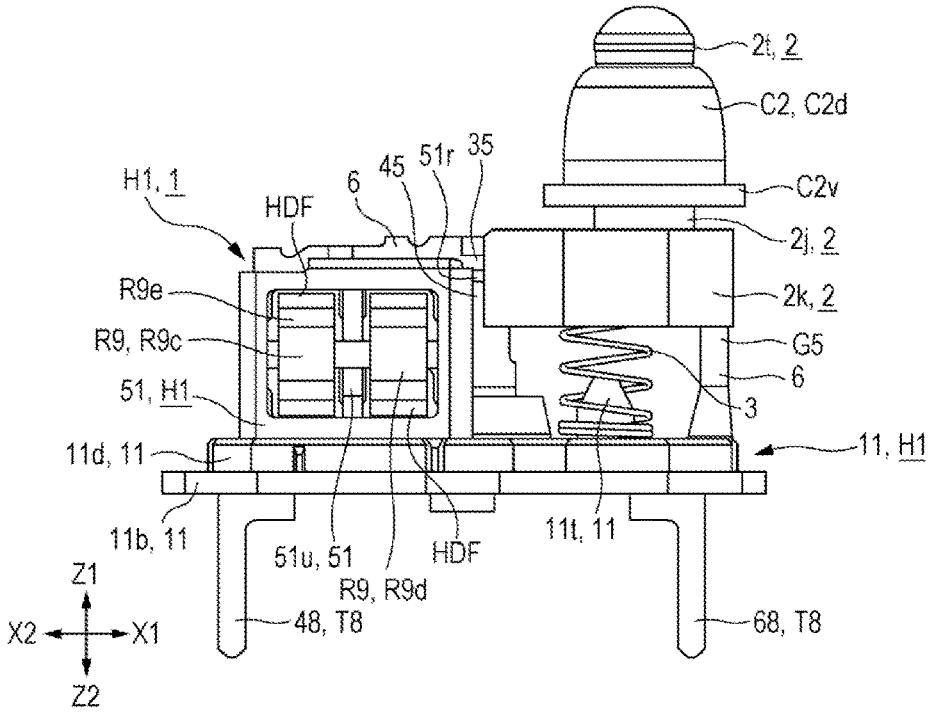
FIGS. 17A and 17B illustrate the switch device according to the second embodiment of the present invention.
Figure 17B:
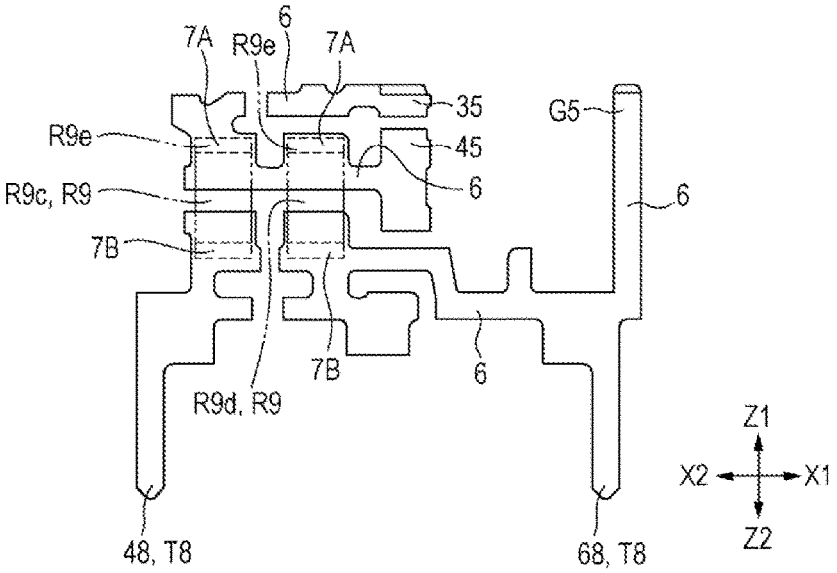

FIG. 16 is a perspective view of the switch device 200 according to the second embodiment of the present invention. FIG. 17A is a front view with the case K1 shown in FIG. 16 omitted, and FIG. 17B is a front view with the holding member H1, moving member 2, cover member C2, biasing member 3, movable contact 4 (see FIG. 8) and resistors R9 shown in FIG. 17A omitted. In FIG. 17B, for ease of explanation, two resistors R9 (resistors R9*c* and R9*d*) are shown in two-dot chain line. FIG. 16 and FIG. 17A show an initial state where the operation portion 2*t* is not operated.

As with the switch device 100 of the first embodiment, the switch device 200 of the second embodiment of the present invention has a box-like appearance shown in FIG. 16, and includes a housing 1 that forms an outer shape, a moving member 2 that is moved by operating an operation portion 2*t*, a biasing member 3 that returns the moving member 2 to the initial state before operation, a movable contact 4 that moves with the movement of the moving member 2, a common fixed contact G5 that is always in contact with the movable contact 4, a first switching fixed contact 35 and a second switching fixed contact 45 that come into and out of contact with the movable contact 4 with the operation of the operation portion 2*t*, extending portions 6 that extend from the common fixed contact G5, the first switching fixed contact 15, and the second switching fixed contact 25, terminal members T8 that extend from the housing 1 to the outside, two resistors R9 for obtaining the resistance value (voltage value) between two terminal members T8. In the second embodiment of the present invention, the switch device 200 further has a cover member C2 disposed on the upper side (Z1 side shown in FIGS. 2A and 2B) of the housing 1 as shown in FIG. 16.

Next, each of the components of the switch device 200 will be described briefly. Detailed description of the housing 1 (case K1 and holding member H1), moving member 2, cover member C2, biasing member 3, movable contact 4, and resistors R9 (resistors R9*c* and R9*d*) (see FIG. 17A), which are the same as those in the first embodiment, will be omitted. So, the first switching fixed contact 35, the second switching fixed contact 45, the common fixed contact G5, the extending portions 6, and the terminal members T8 will be described.

As with the first embodiment, the first switching fixed contact 35, the second switching fixed contact 45, the common fixed contact G5, the extending portions 6, and the terminal members T8 of the switch device 200 according to the second embodiment of the present invention are made of conductive material such as copper, iron, or an alloy mainly composed of them, by punching a sheet of metal member, so as to have independent shapes as shown in FIG. 17B. These are insert-molded before being separated, and are held by the holding member H1. The surface of the metal member is plated, for example, with nickel or silver.

Next, in the initial state, the first switching fixed contact 35 of the switch device 200 is in contact with the contact portion 4*p* of the movable contact 4. The first switching fixed contact 35 comes out of contact with the contact portion 4*p* of the movable contact 4 with the downward operation of the operation portion 2*t*.

Next, in the initial state, the second switching fixed contact 45 of the switch device 200 is out of contact with the contact portion 4*p* of the movable contact 4. The second switching fixed contact 45 comes into contact with the contact portion 4*p* of the movable contact 4 with the operation of the operation portion 2*t*, and the switch device 100 is brought to a switched state.

Next, the common fixed contact G5 of the switch device 200 is always in contact with the movable contact 4 in both the initial state and the switched state where the movable contact 4 is moved with the operation of the operation portion 2*t*.

Next, as shown in FIG. 17B, the extending portions 6 of the switch device 200 are formed so as to extend from the common fixed contact G5, the first switching fixed contact 35, and the second switching fixed contact 45. As shown in FIG. 17B, some of the extending portions 6 have fixing portions 7A to which the electrode portions R9*e* of the resistors R9 are soldered. The extending portions 6 having the fixing portions 7A are held by the holding wall portion 51 of the holding member H1 with the fixing portions 7A exposed.

Finally, as shown in FIG. 17A, the terminal members T8 of the switch device 200 extend from the bottom wall portion 11 of the holding member H1 to the outside and includes a second terminal 48 electrically connected to the second switching fixed contact 45 through the resistor R9*c*, and a common terminal 68 electrically connected to the common fixed contact G5. The common fixed contact G5 (common terminal 68) and the second switching fixed contact 45 are electrically connected to each other through the resistor R9*d*.

As shown in FIG. 17B, some of the terminal members T8 (the second terminal 48 and the common terminal 68) have fixing portions 7B to which the electrode portions R9*e* of the resistors R9 are soldered. The second terminal 48 and the common terminal 68 are held by the holding wall portion 51 of the holding member H1 with the fixing portions 7B exposed.

Since the fixing portions 7A provided in the extending portions 6 and the fixing portions 7B provided in the terminal members T8 are exposed in the frame-like inner part of the holding wall portion 51 and are held by the holding wall portion 51, when placing the resistors R9*c* and R9*d* on their respective fixing portions 7A and 7B and performing soldering, soldering such as reflow soldering can be performed. That is, since the holding wall portion 51 holding the fixing portions 7A and 7B is formed of the first synthetic resin material having heat resistance, the holding wall portion 51 can withstand the temperature of soldering such as reflow soldering, and the resistors R9 can be reliably soldered to the fixing portions 7A and 7B.

Figure 18:
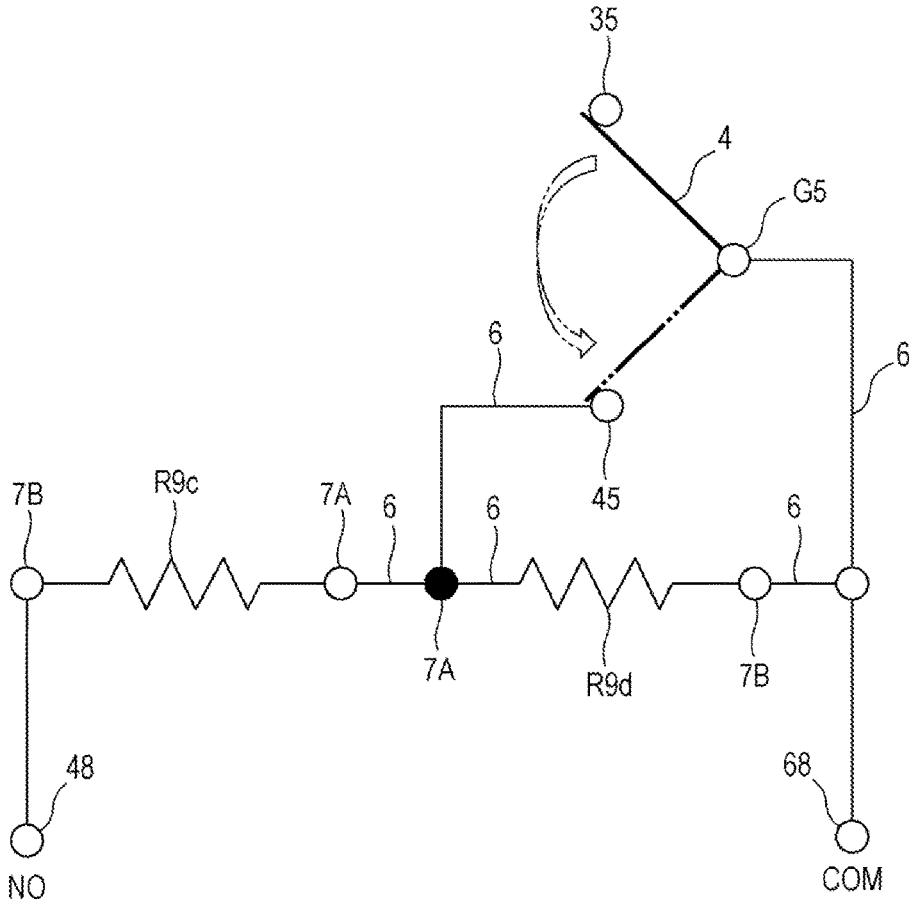
FIG. 18 is a detection circuit diagram of the switch device according to the second embodiment of the present invention.
Figure 19:
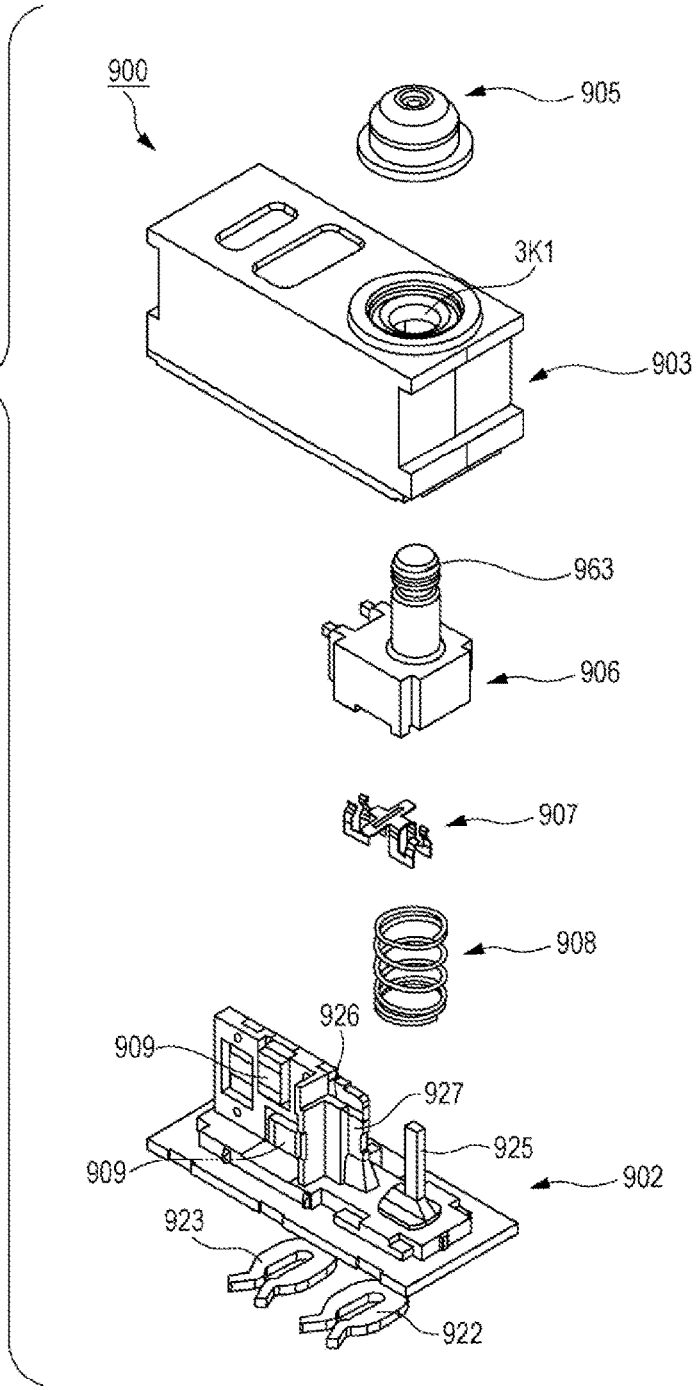
FIG. 19 PRIOR ART
FIG. 19 is an exploded perspective view illustrating a switch device of a conventional example.
Figure 20:
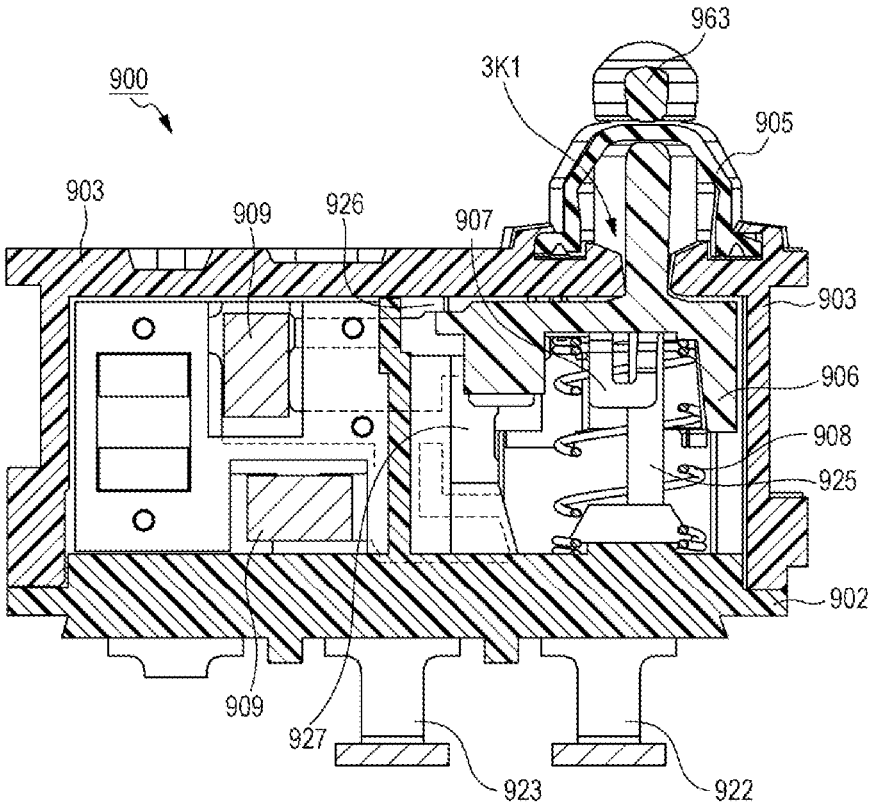
FIG. 20 PRIOR ART
FIG. 20 is a vertical sectional view illustrating the switch device of the conventional example.

Finally, a detection circuit of the switch device 200 according to the second embodiment of the present invention will be described. FIG. 18 is a detection circuit diagram of the switch device 200. FIG. 18 shows the initial state where the operation portion 2*t* is not operated. For ease of explanation, parts corresponding to components of the switch device 200 are indicated with dashed lines.

As shown in FIG. 18, in the detection circuit of the switch device 200, the common fixed contact G5 connected to the common terminal 68 through the extending portion 6 is connected through the movable contact 4 to the first switching fixed contact 35 in the initial state where the operation portion 2*t* is not operated. However, the first switching fixed contact 35 is not in contact with any part, and is a dummy contact.

On the other hand, in the initial state, the second switching fixed contact 45 is connected through the resistor R9*d* to the common terminal 68. At that time, one end of the resistor R9*d* is connected to the fixing portion 7A of the extending portion 6, and the other end of the resistor R9*d* is connected to the fixing portion 7B of the common terminal 68. The second switching fixed contact 45 is also connected through the resistor R9*c* to the second terminal 48. At that time, one end of the resistor R9*c* is connected to the fixing portion 7A of the extending portion 6, and the other end of the resistor R9*c* is connected to the fixing portion 7B of the second terminal 48 (terminal member T8).

When the operation portion 2*t* is operated by depressing operation, the movable contact 4 moves with the movement of the moving member 2, and the movable contact 4 is thereby connected to the second switching fixed contact 45. That is, the switch device 200 is brought to the switched state. When the operation portion 2*t* is released from depression, as described above, the movable contact 4 is pushed back to the initial state by the biasing member 3 (returning member). In this way, the switch device 100 is switched between the initial state and the switched state.

In this detection circuit, in the initial state, a resistance value equal to the sum of the resistance value of the resistor R9*c* and the resistance value of the resistor R9*d* is detected between the second terminal 48 and the common terminal 68. On the other hand, in the switched state, only the resistance value of the resistor R9*c* is detected between the second terminal 48 and the common terminal 68. The on/off of the switch can thereby be detected.

The present invention is not limited to the above-described embodiments, and, for example, the following modifications may be made. Such embodiments are also included in the scope of the present invention.

Modification 1

In the first embodiment, in the joining step S7, laser welding is suitably used to integrate the bottom wall portion 11 and the case K1. However, the present invention is not limited to this. For example, the bottom wall portion 11 and the case K1 may be integrated using an adhesive. For example, even in the case of an unusual material combination of second synthetic resin material and third synthetic resin material that is difficult to join by laser welding, joining can be performed with high adhesion and joint strength by using an adhesive.

Modification 2

In the above-described embodiments, the holding wall portion 51 has the embedded portions 51*m* embedded in the bottom wall portion 11. However, the present invention is not limited to this. For example, the holding wall portion 51 may be formed above the bottom wall portion 11.

The present invention is not limited to the above-described embodiments, and various changes may be made therein without departing from the spirit of the present invention.

What is claimed is:

1. A switch device comprising:

a housing having a through portion;

a moving member provided with an operation portion exposed from the through portion;

a biasing member that returns the moving member to an initial state before operation;

a movable contact that moves with the movement of the moving member;

a common fixed contact that is always in contact with the movable contact;

a first switching fixed contact, the first switching fixed contact being in contact with the movable contact in the initial state where the operation portion is not operated, the first switching fixed contact coming out of contact with the movable contact with the operation of the operation portion;

a second switching fixed contact, the second switching fixed contact being out of contact with the movable contact in the initial state where the operation portion is not operated, the second switching fixed contact coming into contact with the movable contact with the operation of the operation portion;

a plurality of extending portions that extend from at least two of the common fixed contact, the first switching fixed contact, and the second switching fixed contact;

at least two terminal members that extend from the housing to an outside of the housing; and two resistors for obtaining the resistance value between the at least two terminal members, the housing including a box-shaped case that has the through portion and has an open bottom, and a holding member in which the terminal members are embedded and that covers the bottom of the case, some of the extending portions and the terminal members having fixing portions to which the resistors are soldered, wherein the holding member includes a bottom wall portion that covers the bottom of the case, and a holding wall portion provided above the bottom wall portion and holding the fixing portions, and wherein the holding wall portion comprises a first synthetic resin material having heat resistance, and the bottom wall portion is comprises a second synthetic resin material having a heat distortion temperature lower than that of the first synthetic resin material.

2. The switch device according to claim 1, wherein the terminal members extend from the bottom wall portion to the outside of the housing, and wherein a part of each terminal member is surrounded, throughout its circumference, by the second synthetic resin material of the bottom wall portion.

3. The switch device according to claim 1, wherein the holding wall portion is disposed in a sealed housing space formed by the case and the bottom wall portion.

4. The switch device according to claim 1, wherein the holding wall portion has, in a lower part thereof, embedded portions embedded in the bottom wall portion, and wherein the embedded portions are each provided with an engaging portion formed such that the lower part thereof is larger than an upper part thereof.

5. The switch device according to claim 1, wherein the case comprises a third synthetic resin material having a heat distortion temperature lower than that of the first synthetic resin material.

6. The switch device according to claim 5, wherein the second synthetic resin material and the third synthetic resin material are the same type of material.

7. A method for manufacturing a switch device including a housing having a through portion, a moving member provided with an operation portion exposed from the through portion, a biasing member that returns the moving member to an initial state before operation, a movable contact that moves with the movement of the moving member, a common fixed contact that is always in contact with the movable contact, a first switching fixed contact, the first switching fixed contact being in contact with the movable contact in the initial state where the operation portion is not operated, the first switching fixed contact coming out of contact with the movable contact with the operation of the operation portion, a second switching fixed contact, the second switching fixed contact being out of contact with the movable contact in the initial state where the operation portion is not operated, the second switching fixed contact coming into contact with the movable contact with the operation of the operation portion, extending portions that extend from at least two of the common fixed contact, the first switching fixed contact, and the second switching fixed contact, at least two terminal members that extend from the housing to an outside of the housing, and two resistors for obtaining the resistance value between the at least two terminal members, the housing including a box-shaped case that has the through portion and has an open bottom, and a holding member in which the terminal members are embedded and that covers the bottom of the case, some of the extending portions and the terminal members having fixing portions to which the resistors can be soldered, wherein the holding member includes a bottom wall portion that covers the bottom of the case, and a holding wall portion provided above the bottom wall portion and holding the fixing portions, and wherein the holding wall portion is formed of a first synthetic resin material having heat resistance, and the bottom wall portion is made of a second synthetic resin material having a heat distortion temperature lower than that of the first synthetic resin material, the method comprising a first molding step in which the holding wall portion is formed, with the fixing portions exposed, by insert-molding a metal member having the fixing portions using the first synthetic resin material, a resistor mounting step in which the resistors are soldered to the fixing portions, and a second molding step in which the bottom wall portion is formed by insert-molding the terminal members located on the lower side of the holding wall portion using the second synthetic resin material.

8. The method according to claim 7, wherein the resistor mounting step includes a reflow step in which solder paste provided between the fixing portions and electrode portions of the resistors is heated.

9. The method according to claim 7, wherein, in the second molding step, the bottom wall portion is formed such that a part of each terminal member is surrounded, by the second synthetic resin material, and such that the terminal members extend from the bottom wall portion to the outside of the housing.

10. The method according to claim 7, wherein, in the second molding step, the bottom wall portion is formed such that a lower part of the holding wall portion is embedded in the bottom wall portion, and such that the holding wall portion is not exposed on a lower side of the bottom wall portion.

11. The method according to claim 10, wherein, in the first molding step, an engaging portion having a shape such that the lower part thereof is larger than an upper part thereof is formed in each of embedded portions of the holding wall portion that are embedded in the bottom wall portion.

12. The method according to claim 7, further comprising, before the first molding step, a frame body preparation step in which a frame body is prepared to which at least a part of each of the common fixed contact, the first switching fixed contact, the second switching fixed contact, the extending portions, and the terminal members is connected by a connecting portion, and after the second molding step, a cutting step in which the connecting portions are cut.

13. The method according to claim 7, wherein the case is formed of a third synthetic resin material having a heat distortion temperature lower than that of the first synthetic resin material, and wherein the second synthetic resin material and the third synthetic resin material are the same type of material.

* * * * *